US011840820B2

(12) United States Patent
Cui et al.

(10) Patent No.: US 11,840,820 B2
(45) Date of Patent: Dec. 12, 2023

(54) METHOD FOR STRENGTHENING AND LIFTING HIGH-RISE BUILDING HAVING RAFT FOUNDATION

(71) Applicant: BEIJING HENGXIANG HONGYE FOUNDATION REINFORCEMENT TECHNOLOGY CO., LTD., Beijing (CN)

(72) Inventors: Xuedong Cui, Beijing (CN); Jiguang Wu, Beijing (CN); Tengyue Cui, Beijing (CN)

(73) Assignee: BEIJING HENGXIANG HONGYE FOUNDATION REINFORCEMENT TECHNOLOGY CO., LTD., Beijing (CN)

( * ) Notice: Subject to any disclaimer, the term of this patent is extended or adjusted under 35 U.S.C. 154(b) by 71 days.

(21) Appl. No.: 17/549,932

(22) Filed: Dec. 14, 2021

(65) Prior Publication Data

US 2022/0098819 A1 Mar. 31, 2022

Related U.S. Application Data

(63) Continuation of application No. PCT/CN2019/107379, filed on Sep. 23, 2019.

(30) Foreign Application Priority Data

Jun. 14, 2019 (CN) ..... 201910517280.6

(51) Int. Cl.
*E02D 35/00* (2006.01)
*E02D 37/00* (2006.01)

(52) U.S. Cl.
CPC ..... *E02D 35/005* (2013.01); *E02D 37/00* (2013.01); *E02D 2250/003* (2013.01); *E02D 2300/0018* (2013.01)

(58) Field of Classification Search
CPC . E02D 35/005; E02D 37/00; E02D 2250/003; E02D 2300/0018; E02D 3/12; E01D 22/00
See application file for complete search history.

(56) References Cited

U.S. PATENT DOCUMENTS 4,906,140 A 3/1990 Clark
6,302,380 B1 * 10/2001 Ultimo, Sr. ..... E02D 3/12 414/451

(Continued)

FOREIGN PATENT DOCUMENTS

CN 107435346 A 12/2017
CN 207228186 U 4/2018

(Continued)

OTHER PUBLICATIONS

International Search Report of PCT Patent Application No. PCT/CN2019/107379 dated Mar. 13, 2020.

*Primary Examiner* — Carib A Oquendo

(57) ABSTRACT

Disclosed is a method for strengthening and lifting a high-rise building that has a raft foundation, comprising: arranging a plurality of measuring points at intervals around the outer contour of a building, and determining the side to be lifted of the building according to the elevation of the measuring points; distributing a plurality of reinforcement grouting holes perpendicular to a raft foundation at intervals within the range of the raft foundation, and using pressure grouting in the reinforcement grouting holes to form a reinforcement under the raft foundation; laying downwardly inclined lifting holes on the outer side of the raft foundation at two ends close to the side to be lifted of the building; and performing simultaneous pressure grouting in the lifting holes to lift the side to be lifted of the building.

9 Claims, 14 Drawing Sheets

(56) References Cited

U.S. PATENT DOCUMENTS

| | | | | |
|---|---|---|---|---|
| 2018/0016765 | A1* | 1/2018 | Baldwin | E02D 37/00 |
| 2018/0209113 | A1* | 7/2018 | Birtele | E02D 35/005 |
| 2019/0186095 | A1* | 6/2019 | Eddie | G01N 33/24 |
| 2020/0190760 | A1* | 6/2020 | Pastor | E02D 3/12 |

FOREIGN PATENT DOCUMENTS

| | | | |
|---|---|---|---|
| CN | 109083433 | A | 12/2018 |
| JP | 2005213904 | A | 8/2005 |
| WO | 2017013014 | A1 | 1/2017 |

* cited by examiner

METHOD FOR STRENGTHENING AND LIFTING HIGH-RISE BUILDING HAVING RAFT FOUNDATION

CROSS-REFERENCE TO RELATED APPLICATION

The present application is a continuation of international application of PCT application No. PCT/CN2019/107379 filed on Sep. 23, 2019, which claims the priority benefit of China application No. 201910517280.6 filed on Jun. 14, 2019. The entirety of the above-mentioned patent applications is incorporated herein by reference and made a part of this specification.

TECHNICAL FIELD

The present application relates to the technical field of building foundation lifting and strengthening, and more particularly, to a method for strengthening and lifting a high-rise building having a raft foundation.

BACKGROUND ART

Due to architectural reconnaissance, design, construction, or bad weather, etc., a built building will sink due to insufficient foundation strength. If the inclination value of the building exceeds the allowable inclination value, the normal use will be affected. Even cracks and damages will occur, posing a threat to the structural safety of the building. In such a case, lifting correcting and foundation strengthening are needed. The number of floors above the ground of a residential building is 24, the number of the underground floor is 1, and the height of the building is 76 meters. The foundation form of the building is a prestressed pipe pile composite foundation, and the foundation type is a raft foundation. The thickness of the raft foundation is 1.5 meters, the pipe pile with a prestressed diameter of 600 mm is provided at the bottom of the raft foundation, and the pipe pile is arranged in a quincunx shape, the effective pile length being 40 meters. From the top to the bottom, the soil layer structure of the foundation is sequentially clay layer, volcanic ash layer, clay, and mudstone. The pile bottom of the pipe pile is located in the volcanic ash layer. When the construction of the building is completed, uneven settlement occurs. How to reinforce the building to prevent continued settlement and how to lift the building are technical problems to be solved. The patent application document for an invention with the publication number CN107435346A discloses "grouting reinforcement and rectification method suitable for high-rise building structure", specifically disclosing that an under column pile foundation and a reinforcement platform are formed by grouting to achieve the reinforcement of a building. However, the height of the residential building is ultrahigh, the load bearing on the top of the raft foundation is very large, and in addition, the pozzolanic stratum is not compact so that the technical problems of lifting correcting and foundation reinforcement of the building still cannot be solved by using the techniques in the above-mentioned patent application document.

SUMMARY

The object of the present application is to provide a method for strengthening and lifting a high-rise building having a raft foundation, which solves the problems of strengthening and lifting of the settlement of a building having a raft foundation and has the advantages of good overall stability, controllable lifting speed and height, little damage done to a building, and the prevention of re-settlement.

The above object of the present application is achieved by the following technical scheme.

A method for strengthening and lifting a high-rise building having a raft foundation, including:

S1, arranging measuring points: a bottom of the building comprising a raft foundation, arranging a plurality of measuring points at intervals around an outer wall of the building, and determining one side where two points with larger settlement volumes in four corners of the building are located as a side to be lifted according to elevations of the measuring points;

S2, forming a reinforcement: arranging a plurality of reinforcement grouting holes perpendicular to the raft foundation at intervals within a range of the raft foundation, and performing pressure grouting in the reinforcement grouting holes to form a continuous and complete reinforcement greater than a thickness of the raft under the raft foundation;

S3, arranging lifting holes: arranging vertical lifting holes on the raft foundation tightly close to a load bearing wall at a position close to two ends of the load bearing wall on the side to be lifted of the building, wherein the vertical lifting holes penetrates through the raft foundation, and bottoms of the holes extends to a position close to a bottom of the reinforcement; or arranging downwardly inclined lifting holes on an outer side of the raft foundation, wherein the bottom of the holes extends to a position close to the bottom of the reinforcement and is located directly below the load bearing wall;

S4, lifting: performing pressure grouting in the lifting holes simultaneously to lift the side to be lifted of the building, and during the lifting, controlling a lifting speed of two corners of the building of the side to be lifted such that elevations of the two corners is finally lifted simultaneously to a same height as the elevation of corresponding corners of a side not to be lifted of the building; and S5, forming a reinforced pile foundation: drilling a plurality of pile foundation holes on the raft foundation, wherein a drill rod extends from the pile foundation holes into a soil layer below the bottom of the reinforcement, and in a drilling and/or retreating procedure, performing pressure grouting segment by segment and layer by layer to form a continuous pile foundation; and wherein the pile foundation and the reinforcement are combined to form a pile plate reinforced structure for supporting the raft foundation and the building thereon together.

By adopting the above-mentioned technical scheme, the reinforcement is firstly formed by grouting at the bottom of the raft to prevent the building from continuing to settle; then the pressure grouting is performed at the bottom position of the reinforcement below the load bearing wall of the side to be lifted to lift the building at a controllable speed; the reinforcement serves as a stress buffering structure to protect the building from secondary damage in the procedure of lifting; the two ends of the side to be lifted lift at the same time and stop at the same time, avoiding the phenomenon that the side not to be lifted is jointly lifted and further reducing the damage to the building structure during the lifting procedure; the injected grout and filling soil body void during uplift further strengthen the soil layer at the bottom of load bearing wall and effectively avoid the occurrence of the secondary settlement; finally, the reinforced pile foundation is formed by grouting, and in combination with the reinforcement, it forms a pile plate structure to support and reinforce the building to prevent re-settlement. The present application has the advantages of good overall stability, controllable lifting speed and height, little damage done to a building, and the prevention of re-settlement.

In an embodiment of the present application, the drill rod repeatedly drills and retreats in the pile foundation hole for grouting, pressure grouting is performed twice in each segment of the soil layer; a first pressure grouting is filling grouting, and an irregular grouting body is formed around the drill rod after the filling grouting; a second pressure grouting is performed inside the irregular grouting body formed by the filling grouting, in the second pressure grouting, grout uniformly diffuses to a periphery and uniformly mixes with soil body to form a short cylinder with a center of a horizontal section coinciding with a center of the drill rod; all upper and lower continuous short cylinders form a reinforced composite pile foundation, and the reinforced composite pile foundation and the reinforcement are combined to form a pile plate reinforced structure for supporting the raft foundation and the building thereon together.

By adopting the above-mentioned technical scheme, the reinforced composite pile foundation with good support and complete structure in the vertical direction is formed in the uncompacted stratum represented by powdery soil, volcanic ash, etc. as well as in the stratum with fracture channel represented by miscellaneous fill.

The present application is further configured as follows: in step S5, after the drill rod of a drilling and grouting machine drills to a design depth at one time, filling grouting is performed; after the grouting reaches a certain grouting pressure and stabilizes, or after an injection rate of the grout satisfies a design requirement, injected grout fills a relatively less compact area of the soil body around the drill rod, and solidifies within 10 s-60 s, forming the irregular grouting body;

the drill rod retreats upward, and the retreating length is L; then retreating is stopped, and filling grouting continues to be performed; after the grouting reaches a certain grouting pressure and stabilizes, or after the injection rate of the grout satisfies the design requirement, the grouting is stopped to form the irregular grouting body;

the drill rod drills downward again, the advancing length being half of the retreating length L, then drilling is stopped and pressure grouting is performed; in the range of the irregular grouting body, the grout uniformly diffuses to the periphery, after the grouting reaches a certain pressure and stabilizes, or after the injection rate of the grout satisfies the design requirement, the grout uniformly mixes with the surrounding soil body and solidifies to form the short cylinder with a certain strength, and the center of the horizontal section of the short cylinder coincides with the center of the grouting pipe; drilling and retreating are repeated and grouting is performed until the bottom of the reinforcement.

By adopting the above-mentioned technical scheme, the reinforced composite pile foundation with good support and complete structure in the vertical direction is formed in the uncompacted stratum represented by volcanic ash.

The present application is further configured as follows: in step S5, the drill rod drills a length L below the bottom of the reinforcement to perform filling grouting, after the grouting reaches a certain grouting pressure and stabilizes, or after the injection rate of the grout satisfies the design requirement, the grouting is stopped; the injected grout fills a void of the soil body surrounding the drill rod and a through gap channel or fills a relatively less compact area of the soil body surrounding the drill rod, and solidifies within 10 s-60 s; the grout solidifies to form a tree-root-like grouting body or the irregular grouting body;

the drill rod retreats upwards, the retreating length being half of the advancing length L, then retreating is stopped and pressure grouting is performed; in the range of the tree-root-like grouting body and the irregular grouting body, the grout uniformly diffuses to the periphery, after the grouting reaches a certain pressure and stabilizes, or after the injection rate of the grout satisfies the design requirement, the grout uniformly mixes with the surrounding soil body and solidifies to form the short cylinder with a certain strength, and the center of the horizontal section of the short cylinder coincides with the center of the grouting pipe;

drilling and retreating are repeated and grouting is performed until the design depth; the drill rod is pulled out upwards and during the pulling out, the drilling hole is filled tightly by injecting the grout.

By adopting the above-mentioned technical scheme, the problem of secondary settlement caused by softening of the soil body in contact with water, which further decreases the strength of the original foundation, during the drilling procedure of collapsible loess and miscellaneous fill is solved, to ensure the stability of the building when the reinforced composite pile foundation is constructed in the similar stratum; at the same time, the reinforced composite pile foundation with good support and complete structure in the vertical direction is formed in the uncompacted stratum represented by collapsible loess as well as in the stratum with fractures represented by miscellaneous fill.

The present application is further configured as follows: in S5, when filling grouting and pressure grouting are performed, a pressure value between 0-20 m is 0.5 MPa-2.5 MPa; the pressure value between 20 m-30 m is 2.5 MPa-3.5 MPa, the pressure value between 30 m-40 m is 3.5 MPa-4.5 MPa, and the pressure value between 40 m-50 m is 4.5 MPa-5.5 MPa.

By adopting the above-mentioned technical scheme, under this pressure state, the reinforced composite pile foundation with a diameter of more than 3 meters can be formed so that the interval between two reinforced composite pile foundations is increased to 8-15 meters, and the grouting material is saved and the construction efficiency is improved on the premise of meeting the requirement of bearing the load from the top building.

The present application is further configured as follows: the secondary pressure grouting is performed in the reinforcement and between the top surface of the reinforced composite pile foundation and the bottom surface of the raft foundation so that the top end of the reinforced composite pile foundation extends to the bottom surface of the raft foundation 1.

By adopting the above-mentioned technical scheme, a reinforced structure with better stress bearing is formed.

The present application is further configured as: further comprising S4-1, filling and reinforcing: a reinforcing hole being arranged in a middle position of the raft foundation, the bottom of the reinforcing hole extending to a joint surface of the raft foundation and the reinforcement, grouting being performed at a bottom end of the reinforcing hole, and all the voids between the bottom surface of the raft foundation and the top surface of the reinforcement being filled and compacted.

By adopting the above-mentioned technical scheme, after the grouting lifting is completed, grouting reinforcement is provided in the reinforcing hole, to prevent the secondary settlement, which causes secondary damage to the building, of the building due to the uncompacted bottom after the building is lifted.

The present application is further configured as follows: several densification lifting holes are arranged at intervals between original lifting holes along a length direction of a wall body on the side to be lifted; pressure grouting is performed in all the lifting holes at the same time to lift the side to be lifted of the building, and when lifting, the lifting speed of the load bearing wall of the building at each lifting point is controlled, so that each point of the side to be lifted of the building is uniformly lifted, and is finally lifted simultaneously to the same height as the elevation of a corresponding position of the side not to be lifted of the building.

By adopting the above-mentioned technical scheme, the destruction of the building structure caused by the suspension in the midair of the bottom of the raft foundation between the lifting holes at the two ends of the side to be lifted is solved, and the stability of the building structure during the lifting and after the lifting is completed is ensured.

The present application is further configured as follows: in step S3, the lifting hole is arranged on the outer side of the raft foundation, two lifting holes are correspondingly arranged at each building corner of the side to be lifted, and the two lifting holes are respectively located on the outer side of two outer contour lines perpendicular to each other of the raft foundation; the bottoms of the two lifting holes respectively extend to be directly below two mutually perpendicular load bearing walls.

By adopting the above-mentioned technical scheme, firstly, a structural column is provided at the corners for being used as the lifting stress bearing places so that the lifting is more controllable, the damage done to the building structure is smaller, and the lifting procedure control is also facilitated; secondly, through two inclined lifting holes, the injected grout is continuously accumulated toward the middle position of the building raft, making the lifting efficiency higher and saving materials; thirdly, two lifting holes respectively extend to be directly below the mutually perpendicular load bearing walls, so that the two walls at the corner of the building are stressed at the same time, thereby better protecting the internal stress of the building structure and reducing the damage.

The present application is further configured as follows: in step S4, when lifting, intermittent grouting lifting is adopted where the grouting is firstly performed to lift a certain height, grouting is suspended for a period of time, and then grouting is performed to lift a certain height.

By adopting the above-mentioned technical scheme, the intermittent grouting lifting firstly lifts the building and then suspends to redistribute the stress in the building. After the building is adapted to the stress after lifting, the grouting lifting is performed for a certain height to avoid secondary damage to the building during lifting and ensure the structural stability of the building.

In summary, the advantageous technical effects of the present application are as follows.

1. The reinforcement is firstly formed by grouting at the bottom of the raft to prevent the building from continuing to settle; then the pressure grouting is performed at the bottom position of the reinforcement below the load bearing wall of the side to be lifted to lift the building at a controllable speed; the reinforcement serves as a stress buffering structure to protect the building from secondary damage in the procedure of lifting; the two ends of the side to be lifted lift at the same time and stop at the same time, avoiding the phenomenon that the side not to be lifted is jointly lifted and further reducing the damage to the building structure during the lifting procedure; the injected grout and filling soil body void during uplift further strengthen the soil layer at the bottom of load bearing wall and effectively avoid the occurrence of the secondary settlement; finally, the reinforced pile foundation is formed by grouting, and in combination with the reinforcement, it forms a pile plate structure to support and reinforce the building to prevent re-settlement. The present application has the advantages of good overall stability, controllable lifting speed and height, less damage to buildings and preventing re-settlement.

2. The different arrangement modes of the position of the lifting hole not only ensure the lifting and strengthening of the building, but also can be applied to a variety of different construction environments, thereby improving the application scope of the process.

3. The lifting adopting the intermittent lifting process firstly lifts the building and then suspends to redistribute the stress in the building. After the building is adapted to the stress after lifting, the grouting lifting is performed for a certain height to avoid secondary damage to the building during lifting and ensure the structural stability of the building.

4. The arrangement of the reinforcing hole further prevents the occurrence of the secondary settlement of the building.

5. Through the process of repeated drilling and retreating grouting by layering, the reinforced composite pile foundation with good support and complete structure in the vertical direction is formed in the uncompacted stratum represented by powdery soil, volcanic ash, etc. as well as in the stratum with fracture channel represented by miscellaneous fill.

DETAILED DESCRIPTION

The present application will be described below in further detail with reference to the accompanying drawings.

Figure 1:
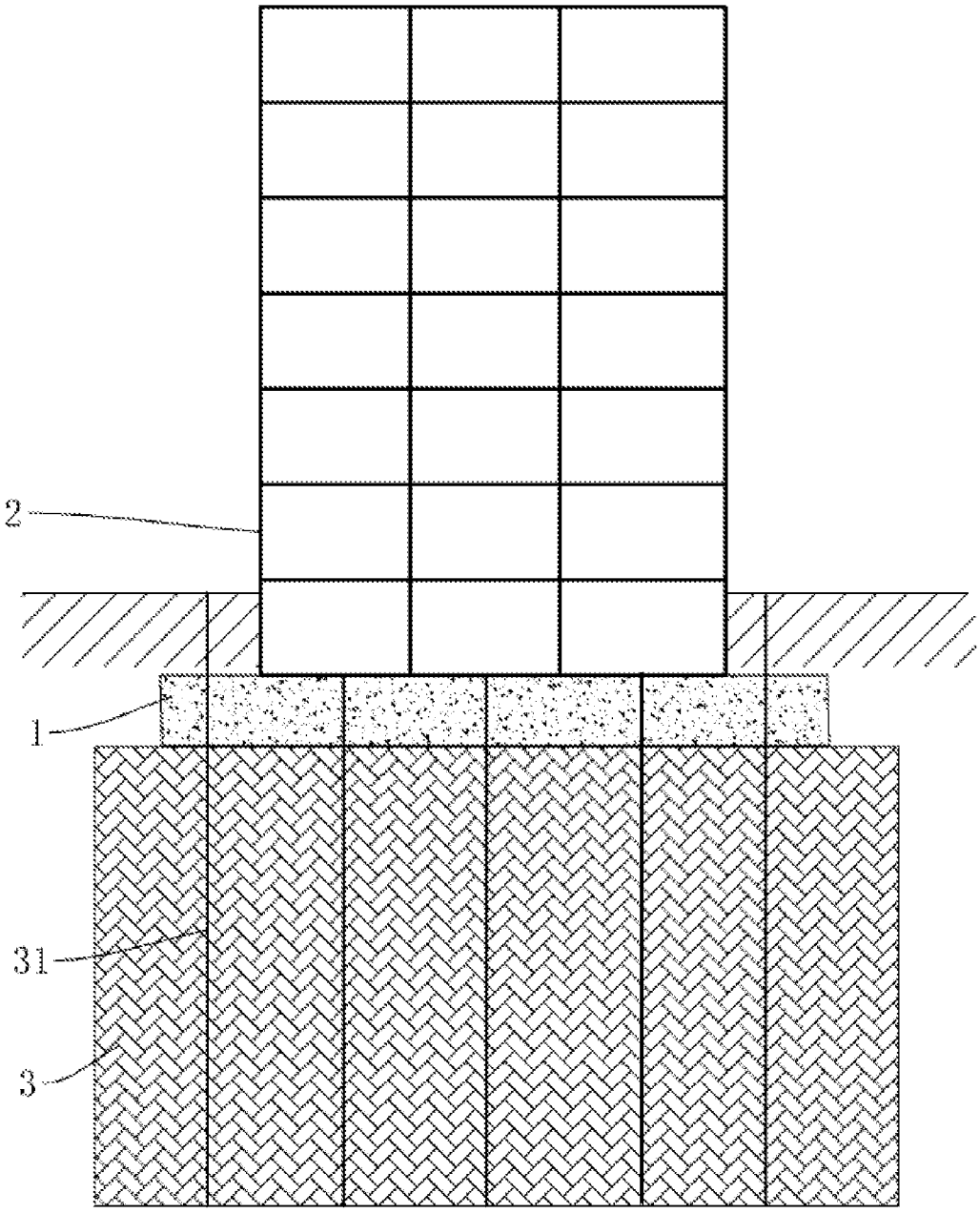
FIG. 1 is a schematic elevational view of a highlighted reinforcement according to the present application.
Figure 2:
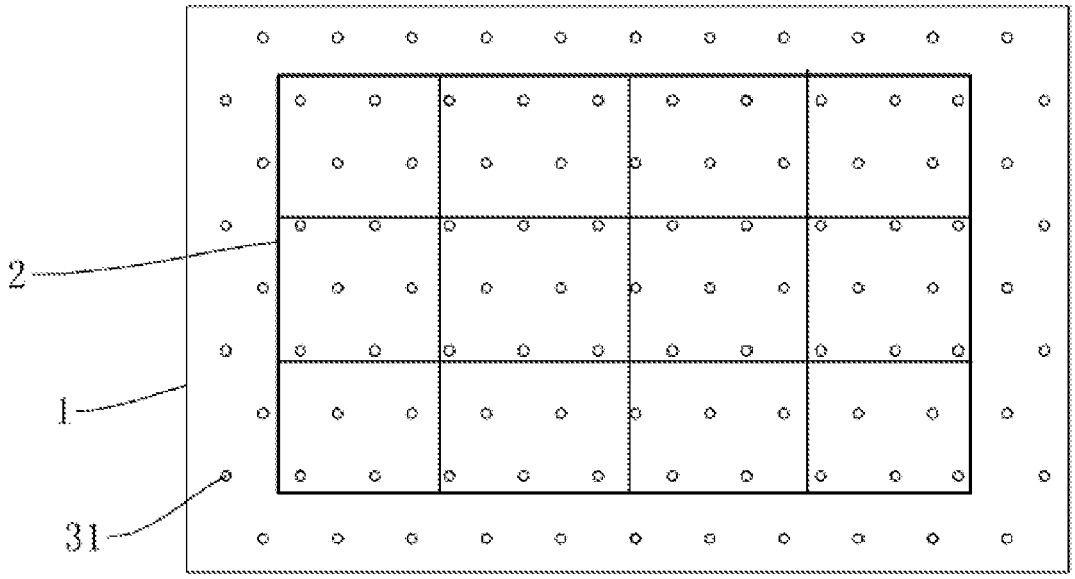
FIG. 2 is a schematic top view highlighting the arrangement position of a reinforcement grouting hole according to the present application.

With reference to FIGS. 1 and 2, a method for strengthening and lifting a high-rise building having a raft foundation disclosed in the present application includes the following steps.

S1, arranging measuring points: uniformly arranging a plurality of measuring points at intervals around the outer contour of a building, measuring the elevation of each measuring point by using a level gauge, and determining that one side where two points with large settlement volumes in four corners of the building are located is a side to be lifted according to the elevation of the measuring point.

S2, forming a reinforcement 3: with reference to FIGS. 1 and 2, according to the geological conditions and hydrological conditions, the reinforced area is determined; if the bottom of the raft foundation 1 of the building is a soft stratum such as a fill, the entire area is reinforced, and if a part below the raft foundation 1 is a hard rock stratum or an original state soil layer with a relatively high bearing capacity, the reinforcement is performed only in the filling area. This embodiment is described in terms of the reinforcement of the entire area.

As shown in FIG. 2, a plurality of reinforcement grouting holes perpendicular to the raft foundation 1 is distributed at intervals of quincunx shape within the range of the reinforcement of the bottom of the raft foundation 1. The rebar protective layer on the surface of the raft foundation 1 is firstly broken at the reinforcement grouting hole 31 to expose the raft rebar, and then a drilling machine (which may be a water drill) is used to drill the reinforcement grouting hole 31 on the raft foundation 1 by passing through the gap of rebars. In the present embodiment, the diameter of the reinforcement grouting hole 31 is 42 mm, a quincunx arrangement is adopted, and the interval between adjacent reinforcement grouting holes 31 is 3-6 m. When the reinforcement grouting holes 31 conflict with the position of the wall body, the interval between the reinforcement grouting holes 31 is appropriately adjusted.

Referring back to FIG. 1, pressure grouting is performed into the reinforcement grouting hole 31 to, under the raft foundation 1, form a continuous and complete reinforcement 3 greater than the thickness of the raft. Specifically, when grouting, a drilling and grouting machine is adopted for drilling and grouting, the diameter of the drill rod is 42 mm, a double core pipe is adopted, the diameter of the inner core is 12 mm, and the grouting drill bit is a double-grout mixer. The retreating grouting process is adopted. The drill rod drills into the ground from the reinforcement grouting hole 31 to a depth greater than the thickness of the raft foundation 1, preferably into the stratum with a greater bearing capacity of the lower foundation. In this embodiment, 16 m below the bottom of the raft foundation 1 is drilled. And then the grouting is started. The injected grout used for the grouting uses a two-component composite grout. The two grouts respectively reach the grout outlet of the grouting pipe (namely, the drill rod 93) from different channels of the drill rod, press into the surrounding soil body at the grout outlet, converge in the soil body, and then a chemical reaction occurs. The initial set is completed within 5 s-60 s.

Then, lifting grouting is performed in segments with a grouting pressure of 0.8-1.5 MPa. Each time when one segment is lifted, the grouting is performed on one segment. The lifting is 0.3-0.5 m at each time, up to the bottom of the raft foundation. The grouting is then performed by adopting a hole-jumping method. After all the reinforcement grouting holes 31 have been grouted, a continuous and complete reinforcement 3 is formed at the bottom of the raft foundation.

Figure 3:
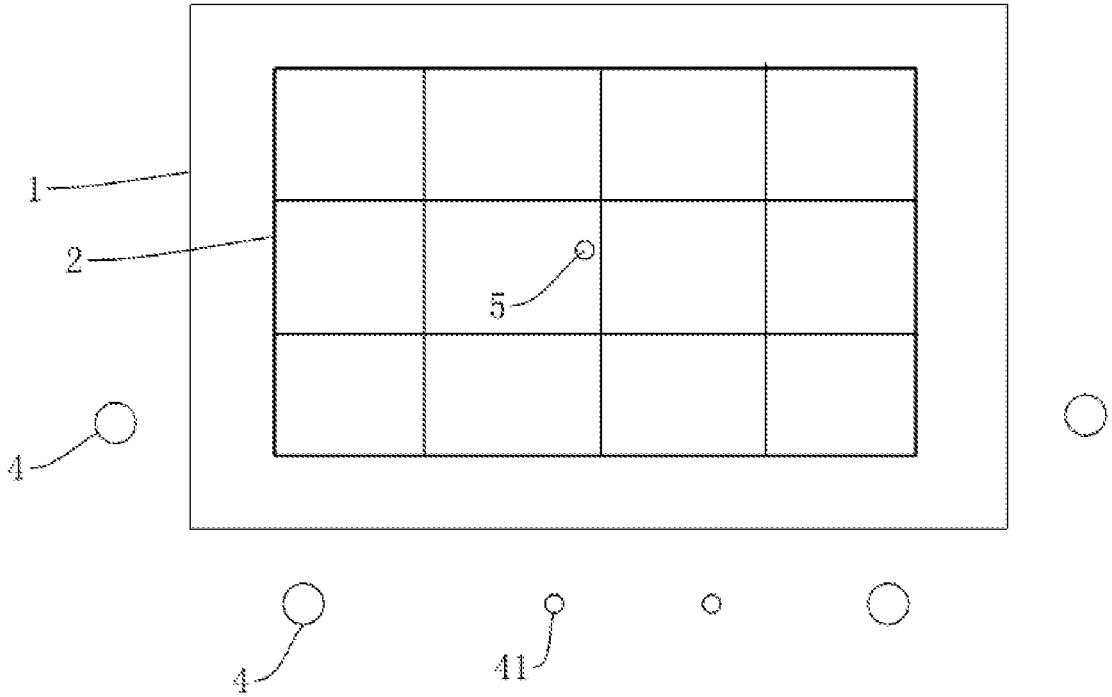
FIG. 3 is a schematic top view highlighting the arrangement position of a lifting hole in embodiment 1 according to the present application.
Figure 4:
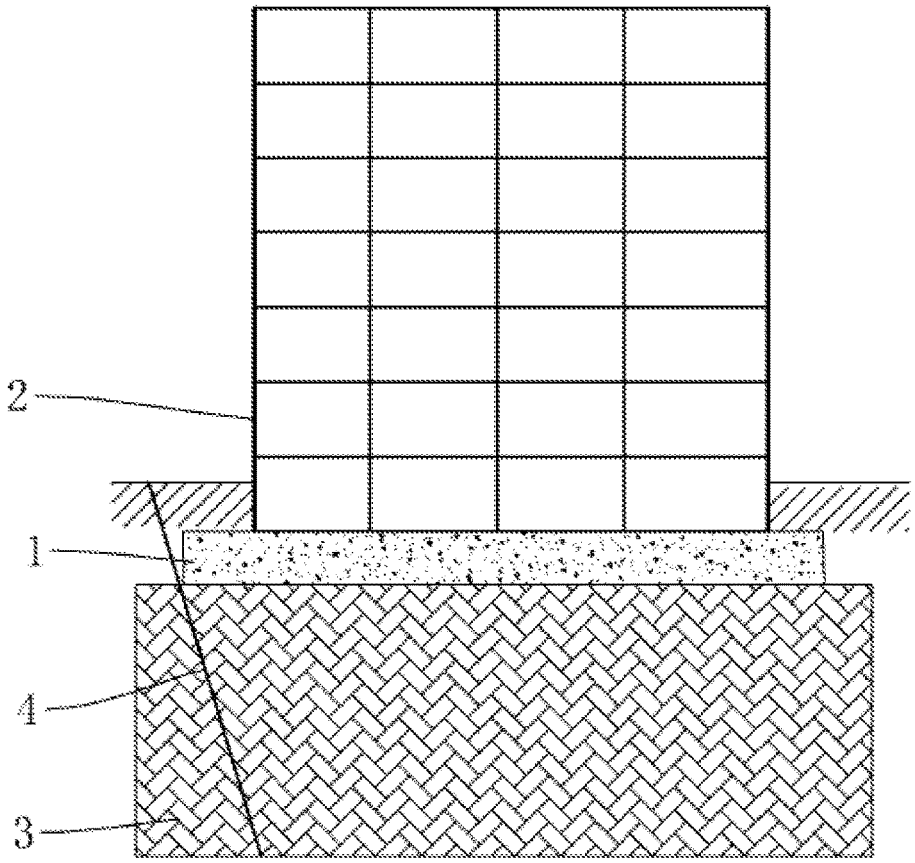
FIG. 4 is a schematic elevational view highlighting a lifting hole in embodiment 1 according to the present application.

S3, arranging lifting hole 4: with reference to FIGS. 3 and 4, arranging lifting holes 4 respectively on positions close to two ends of a load bearing wall 2 close to the side to be lifted of the building, arranging downwardly inclined lifting holes 4 on the outer side of the raft foundation 1, two lifting holes 4 being correspondingly arranged at each building corner of the side to be lifted, and the two lifting holes 4 being respectively located on the outer sides of two outer contour lines perpendicular to each other of the raft foundation 1; each extending directly below two mutually perpendicular load bearing walls 2 respectively. Before drilling the lifting hole 4, according to the buried depth and thickness of the raft, and the depth parameters of the bottom of the lifting hole 4, etc., the opening position and the inclination angle are calculated to ensure that the lifting hole 4 does not pass through the raft foundation 1, but is drilled close to the edge of the raft foundation 1 into the bottom of the load bearing wall 2. When drilling, the drill rod of a drilling and grouting machine is adopted to directly drill.

The depth of the lifting hole 4 should be 5-10 times of the thickness of the raft foundation 1 to ensure that there is sufficient buffer zone between the grout outlet and the bottom of the raft foundation 1 to avoid damage to the raft foundation 1; at the same time, grouting and lifting effect can be considered and material waste can be avoided. Since the thickness of the raft foundation 1 has a certain linear relationship with the height of the building, the higher the building is, the thicker the thickness of the raft foundation 1 is, and likewise, the higher the building is, the greater the force required for lifting and the greater the thickness of the buffer zone is required. So the thickness of the raft foundation 1 is selected as the basic parameter for setting the depth of the lifting hole 4.

Figure 5:
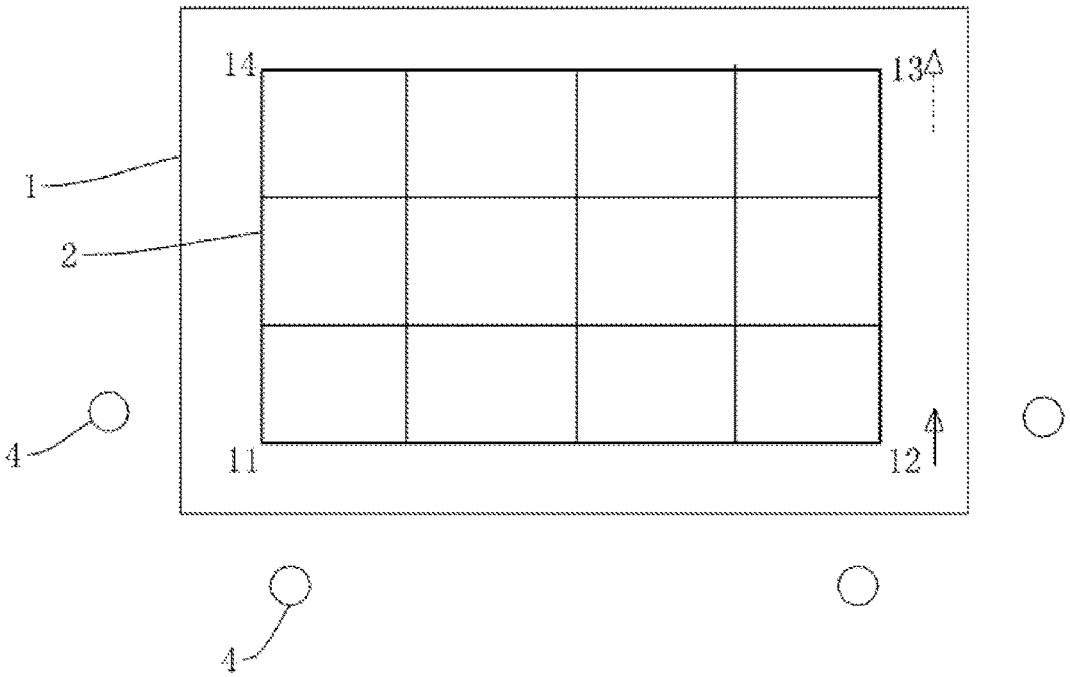
FIG. 5 is a corner numbering schematic view illustrating the lifting principle in embodiment 1.

S4, lifting: according to many field lifting experiences, in the process of actually building lifting, if only one corner point of the building is lifted during lifting, it will cause the side not to be lifted of the building to be lifted jointly. As shown in FIG. 5, the building corners are numbered 11, 12, 13, and 14. Points with large settlement volumes are 11 and 12. When only grouting and lifting 12, 13 on the side not to be lifted will be lifted jointly. Especially when the edge where 12 and 13 are located is a short edge which generates the phenomenon of joint lifting more easily, and at the same time, point 11 will be accelerated to sink. If the grouting and lifting operations are performed at the same time at point 11 and point 12, the joint lifting at point 13 can be avoided. Therefore, the grouting lifting work must be performed simultaneously at two corners on the side to be lifted.

When lifting, pressure grouting is simultaneously performed into the lifting hole 4 at the side to be lifted of the controlled building, the grout adopted by pressure grouting is a two-component grout, grouts of different components are pressed into the soil body at the grout outlet at the bottom of the grouting pipe or drill rod and converge to react and solidify, the initial setting time is 5-60 s, and the grouting pressure is 1.2-2.5 Mpa. At this time, taking the side not to be lifted as the rotation axis for the side to be lifted, the side to be lifted of the building is slowly lifted to avoid the side not to be lifted being jointly lifted. During the lifting, the elevation data of each measuring point of the building is collected by adopting a level gauge and real-time monitoring is performed. The lifting speed of the two corners of the building on the side to be lifted is controlled by adjusting the grouting pressure and the concentration of the grout so that the two corners are lifted at a constant speed, and are finally, simultaneously lifted to the same height as the elevation of the corresponding corners on the side not to be lifted of the building. In the grouting procedure, the lifting speed is controlled so that the two corners reach the final elevation at the same time. This technical measure prevents the corner on the side not to be lifted from being lifted jointly when grouting is continued on the other corner while one corner stops.

Further, intermittent grouting and lifting is adopted during grouting lifting. Firstly the grouting lifting is performed for a certain height, the grouting is suspended for a certain time, and then the grouting lifting is performed for a certain height. Each lifting is generally 1 cm, and the suspending time is generally 12-24 h. The intermittent grouting lifting first lifts the building and then suspends to redistribute the stress in the building. After the building is adapted to the stress after lifting, the grouting lifting is performed for a certain height to avoid secondary damage to the building during lifting and ensure the structural stability of the building.

Referring back to FIG. 3, when the side to be lifted is the long edge of the building, the distance between the lifting points of the two ends generally exceeds 10 meters, in which case the raft foundation 1 hangs in the air in the middle, which is disadvantageous to the structure of the raft foundation 1. Therefore, it is preferable to arrange several densification lifting holes 41 at intervals on the side to be lifted along the length direction of the wall body between the original lifting holes 4. Preferably, the bottom of the densification lifting hole 4 extends directly below the structural column. Pressure grouting is performed in all the lifting holes 4 at the same time to lift the side to be lifted of the building. During lifting, the lifting speed of the load bearing wall 2 of the building at each lifting point is controlled to enable each lifting point of the side to be lifted of the building to lift at a uniform speed, and finally, the lifting is performed at the same time to the same height as the elevation of the corresponding positions of the side not to be lifted of the building.

After the lifting is completed, corner 11 and corner 14 of the building have the same elevation and corner 12 and corner 13 have the same elevation. At this time, if the elevation difference between corner 11 and corner 13 is not large, for example, less than 2 cm, the lifting may not be performed; if there is a large difference in the elevation between the two, for example, more than 5 cm, it can be determined whether to perform the lifting again according to the actual situation. If the lifting is to be continued, the edge where corner 12 and corner 13 are located is defined as the side to be lifted, and then steps S3 and S4 are repeated, and finally, the four corner points (namely, all the elevations of the raft foundation 1) are lifted to a uniform elevation to be substantially flush.

Figure 6:
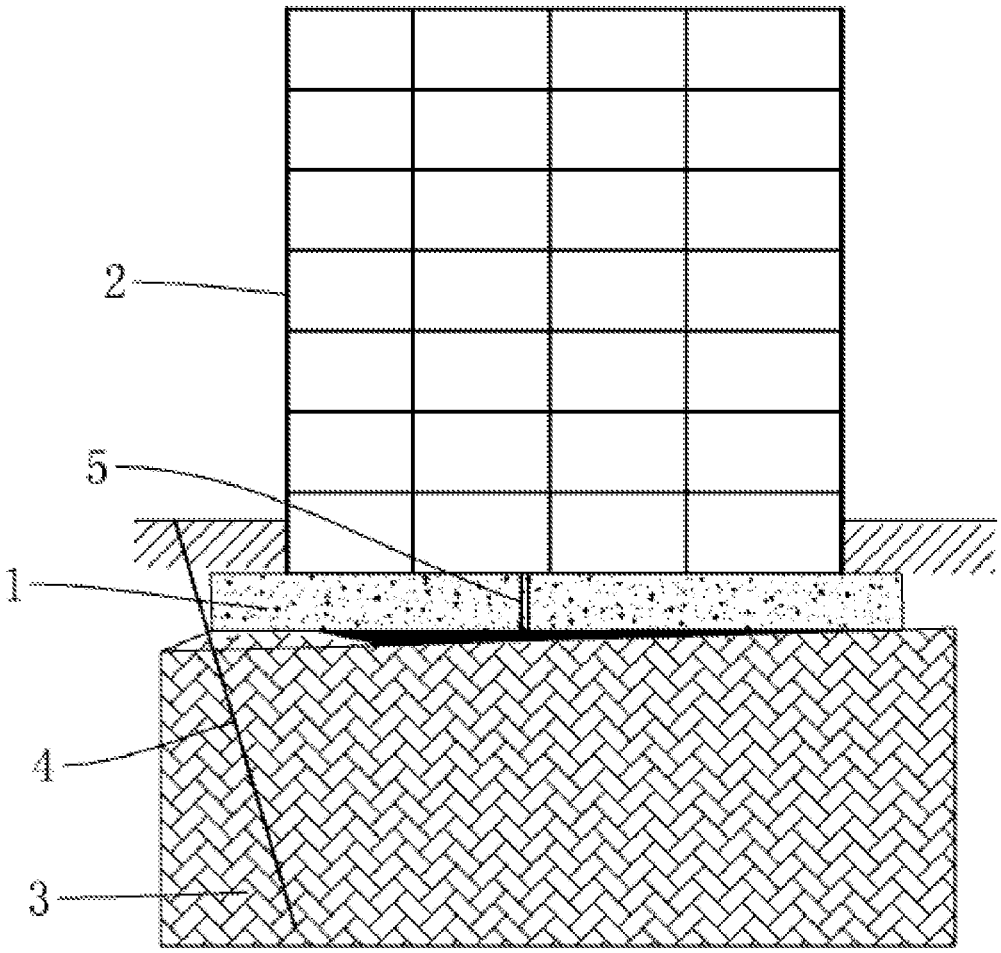
FIG. 6 is a schematic elevational view highlighting a reinforcing hole performing filling grouting on the bottom of the raft foundation.

S5, reinforcing: in conjunction with FIGS. 3 and 6, a reinforcing hole 5 is arranged at the middle position of the raft foundation; the reinforcing hole 5 can use the original reinforcement grouting hole 31, and the bottom of the reinforcing hole 5 extends to the joint surface of the raft foundation and the reinforcement 3; grouting is applied to the bottom end of the reinforcing hole 5 to fill and compact the void between the bottom surface of all the raft foundation and the top surface of the reinforcement 3 to prevent the building from re-settlement after the grouting lifting is completed. Cement grout is generally adopted for the grout injected into the reinforcing hole 5. When the valve plate area is large, a plurality of reinforcing holes 5 may be provided at intervals. When grouting the reinforcing hole 5, several original reinforcement grouting holes 31 close to the outer wall of the building are selected as exhaust holes, and other grouting reinforcing holes are sealed. When the grout is returned from these exhaust holes, the void is proved to have been filled tightly.

Figure 7:
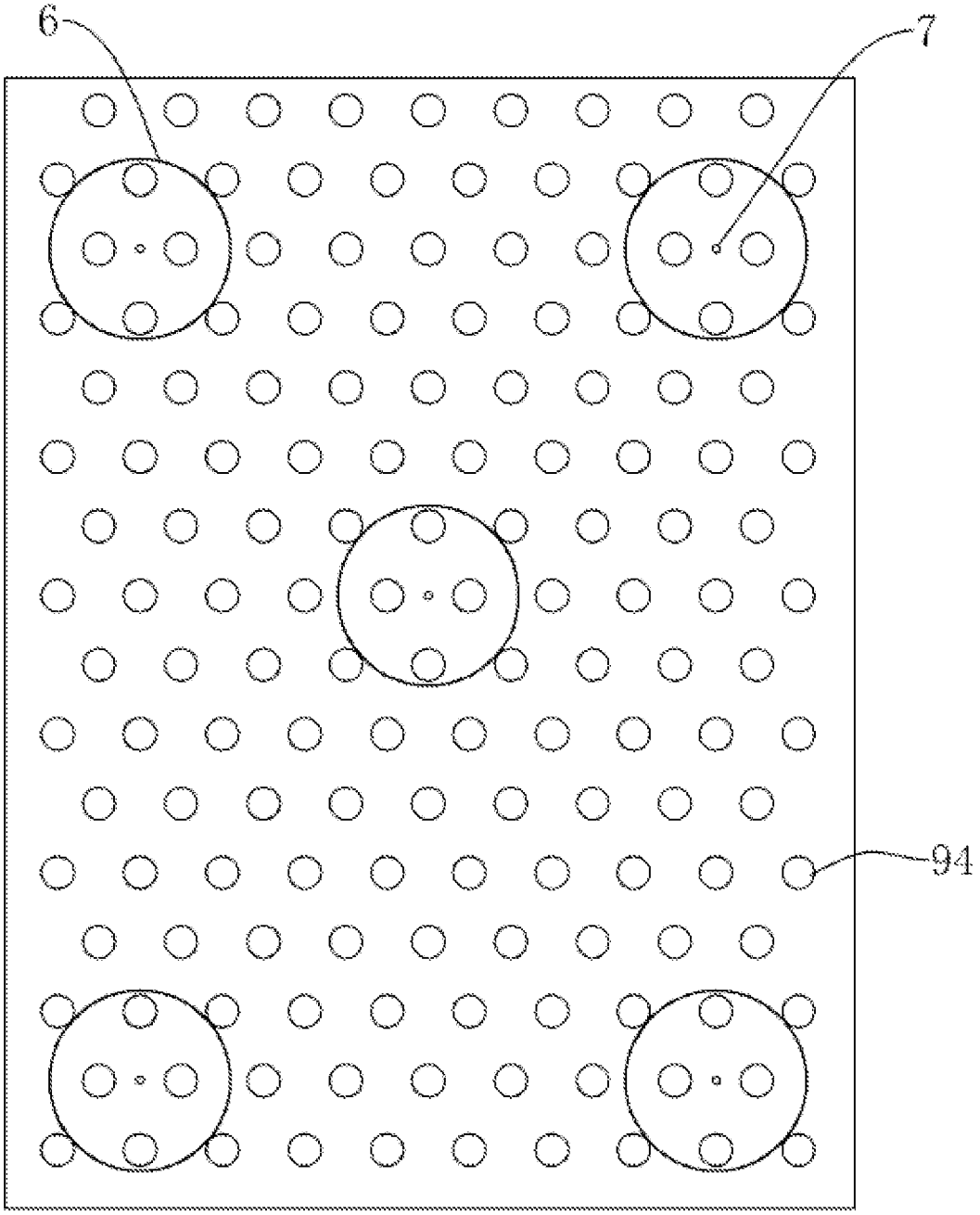
FIG. 7 is a schematic view showing the plane arrangement relationship among pile foundation hole, reinforced composite pile and the existing pipe pile.

S6, forming a reinforced pile foundation: as shown in FIG. 7, a plurality of pile foundation holes 7 is drilled on the raft foundation 1, and the drill rod of the drilling and grouting machine extends from the pile foundation hole 7 into the soil layer below the bottom of the reinforcement 3. It is possible to adopt two kinds of processes: integrally advancing grouting or integrally retreating grouting which is pressure grouting by layering and being in segments. The process adopted in forming reinforcement 3 in step S2 of the present embodiment is the same as the adopted method of integrally retreating grouting by layering. The principle of the main steps of the integrally advancing grouting method is to drill downward one section, then perform pressure grouting, then continue to drill downward and perform grouting, and after drilling to the design depth and completing grouting, pull up the drill rod 93.

Both the integrally advancing grouting and integrally retreating grouting can be used in the construction of reinforced pile foundation in ordinary foundation and stratum. However, when the foundation is a special stratum such as volcanic ash, collapsible loess, and miscellaneous fill, etc., adopting the conventional grouting process cannot form a completely and effectively supporting reinforced pile foundation due to the lack of geological compactness or the existence of void channel. At this time, it is necessary to adopt the process of repeatedly recycling drilling and retreating to form a reinforced composite pile foundation 6.

The specific construction steps of strengthening the composite pile foundation 6 are introduced in combination with the conditions of the volcanic ash stratum.

Figure 8:
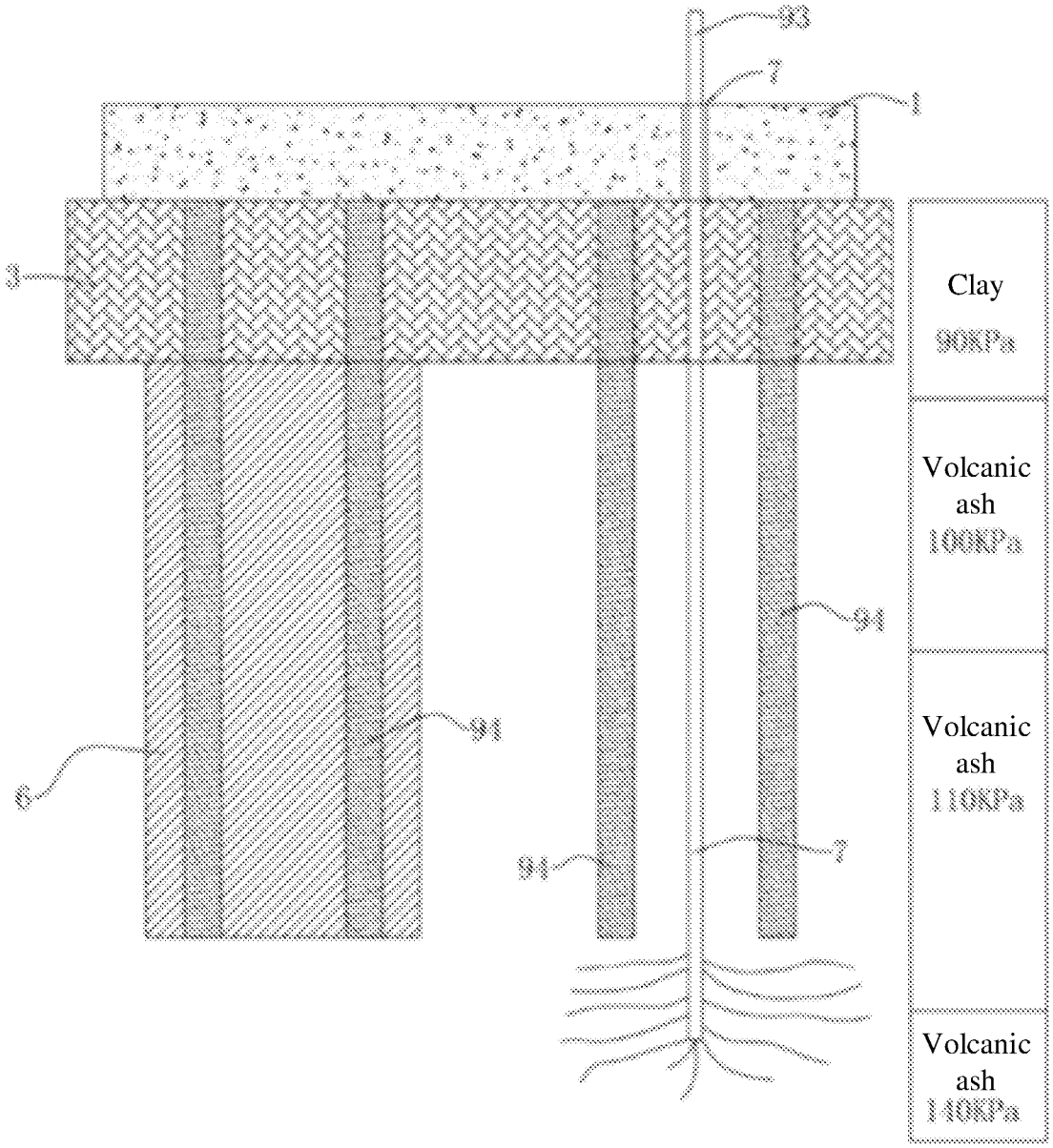
FIG. 8 is a schematic view showing the elevational arrangement relationship among the reinforced composite pile foundation, the reinforcement, and the existing pipe pile.

In step S6-1, in conjunction with FIG. 7 and FIG. 8, a plurality of pile foundation holes 7 is drilled in the raft foundation 1, or the original reinforcement grouting hole 31 is used as the pile foundation hole 7. The pile foundation holes 7 are arranged in a quincunx shape, the interval between two adjacent pile foundation holes 7 is generally not less than 6 m, and when the width of the raft foundation of a building is less than 15 m, only arranging two rows will be enough. When the pile foundation hole 7 conflicts with the position of the wall body or the structural column, the interval between the pile foundation holes 7 is appropriately adjusted. In the engineering project, the interval of 7 quincunx arrangement of pile foundation holes 7 is 8.0×12.0 m.

Step S6-2, as shown in FIG. 8, the drill rod 93 of the drilling and grouting machine is inserted from the pile foundation hole 7 and then drilled into the soil layer below the bottom of the raft foundation 1; the drill rod 93 has a diameter of 42 mm, a double core pipe is adopted, the inner core diameter is 12 mm, and the grouting drill bit is a double grout mixer.

Figure 9:
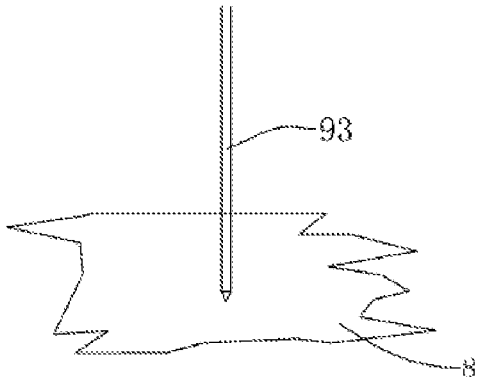
FIG. 9 is a schematic view showing a structure of an irregular grouting body formed by primary filling grouting.
Figure 10:
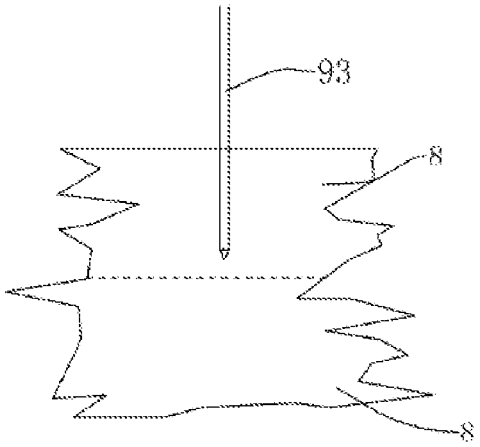
FIG. 10 is a schematic view showing a structure of an irregular grouting body after the grouting after drill rod retreats.
Figure 11:
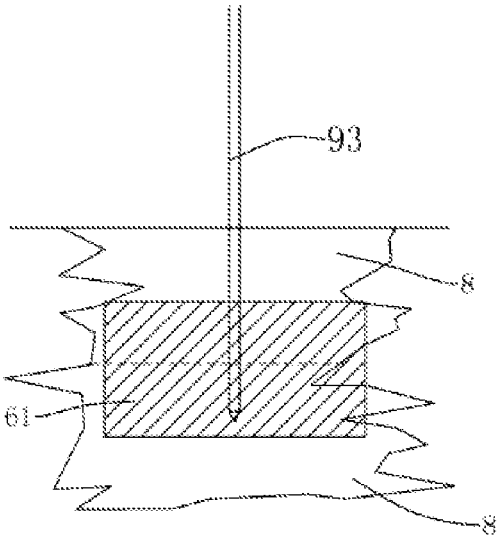
FIG. 11 is a schematic view of a uniform short cylinder formed by pressure grouting after the drill rod advances again to insert into the irregular grouting body.
Figure 12:
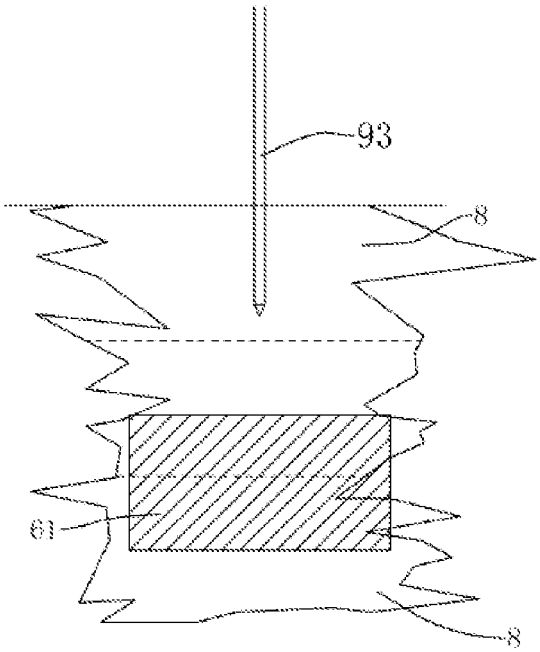
FIGS. 12 and 13 are schematic views of a grouting structure formed by retreating and drilling repeatedly.
Figure 13:
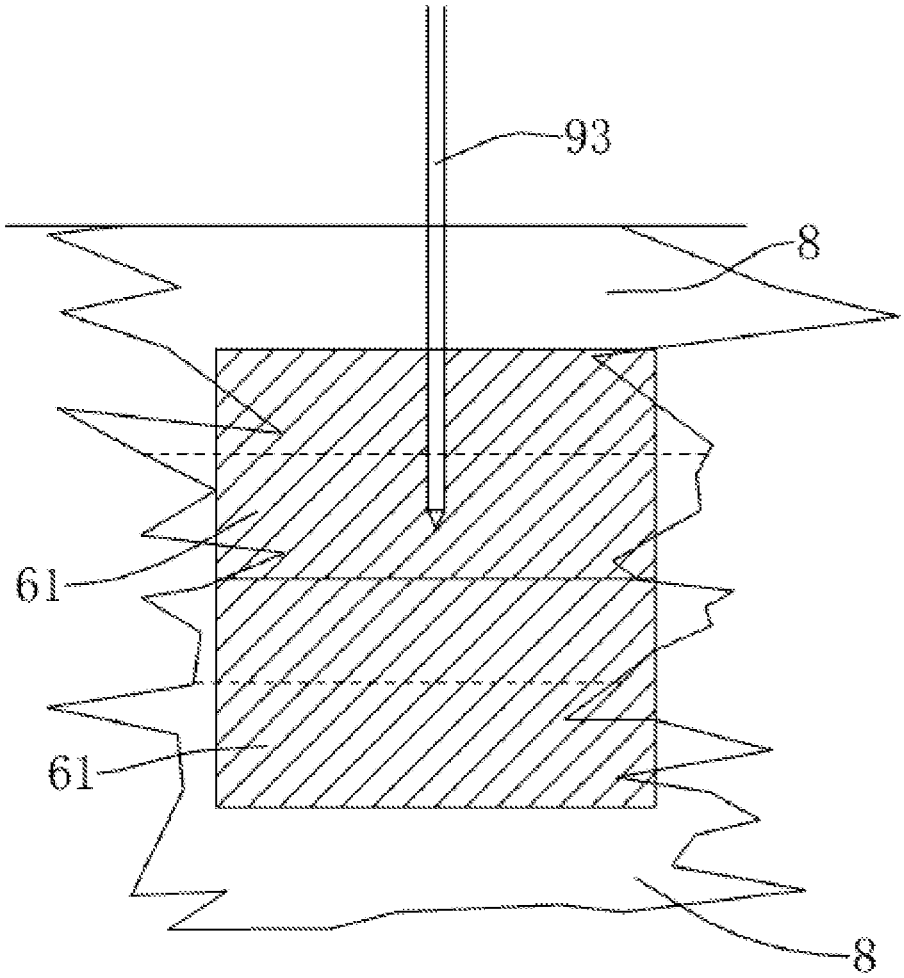
Figure 14:
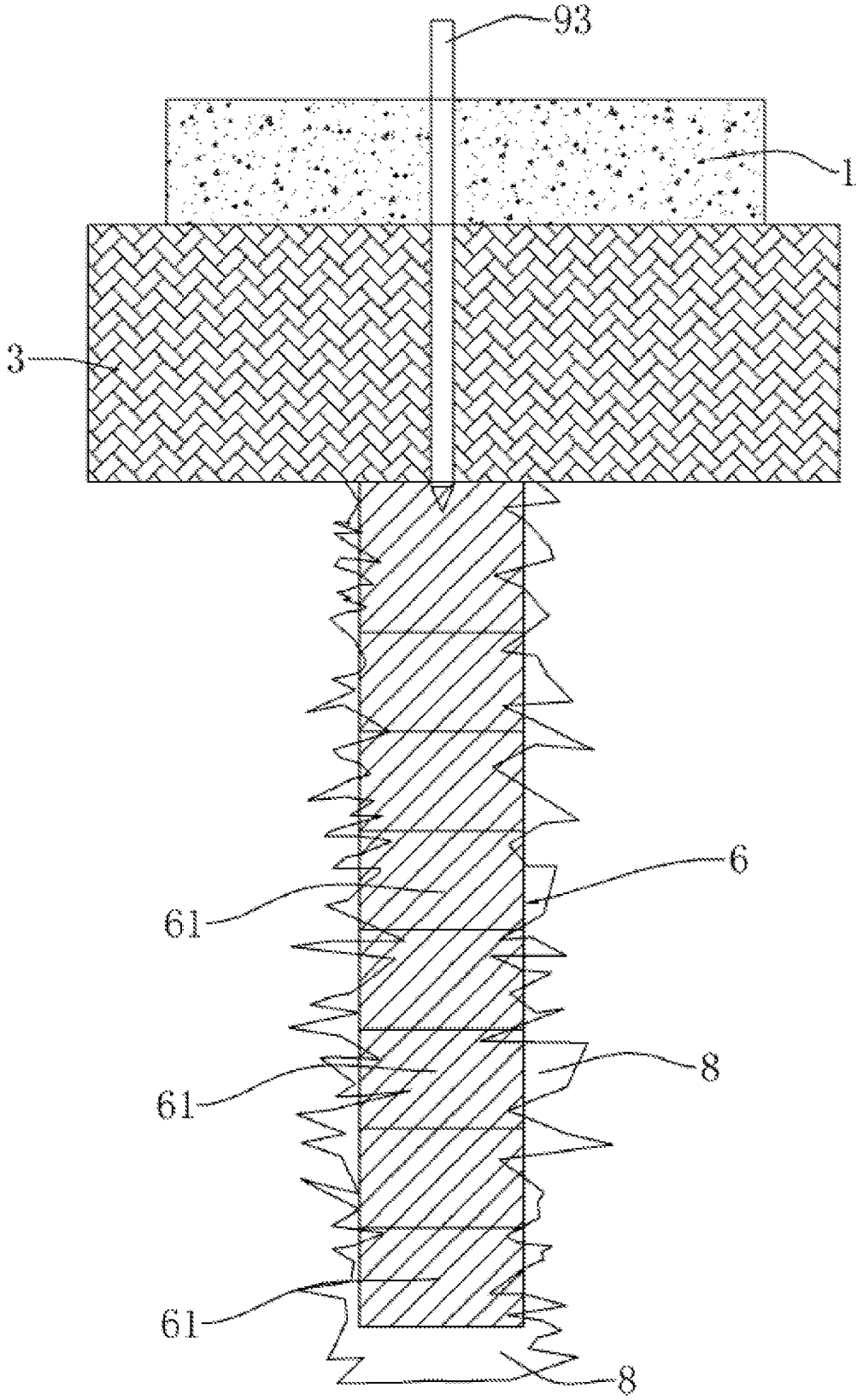
FIG. 14 is a schematic view of a reinforced composite pile foundation formed after the drill rod retreats to the bottom of the reinforcement.

Step S6-3, after drilling to the design depth, filling grouting is performed; as shown in FIG. 8, the deepest drilling place is preferably drilling into the next stratum of the stratum where the bottom end of the pile foundation is located or into the bearing layer with high bearing capacity (bearing capacity greater than 220 KPa). It is to be noted that the "design depth" is not the bottom end position of the finally formed reinforced composite pile foundation 6, but exceeds the bottom end position of the composite pile foundation. In the engineering example, drilling is performed into a stratum with a bearing capacity of 140 KPa. As shown in FIG. 9, after the grouting reaches a certain grouting pressure and stabilizes, or after the injection rate of the grout satisfies the design requirement, the injected grout fills a relatively less compact area of the soil body around the drill rod 93, and solidifies within 10 s-60 s, forming an irregular grouting body 8;

step S6-4, as shown in FIG. 10, the drill rod 93 retreats upward, and the retreating length is L, L being 1.5-3 m; in the engineering project, L is 2 m; then retreating is stopped, and filling grouting continues to be performed; after the grouting reaches a certain grouting pressure and stabilizes, or after the injection rate of the grout satisfies the design requirement, the grouting is stopped to form an irregular grouting body 8;

step S6-5, as shown in FIG. 11, the drill rod 93 drills downward again, the advancing length being half of the retreating length L, then drilling is stopped and pressure grouting is performed; in the range of the irregular grouting body 8 formed by the grouting in steps 6-3 and 6-4, the grout uniformly diffuses to the periphery, after the grouting reaches a certain pressure and stabilizes, or after the injection rate of the grout satisfies the design requirement, the grout uniformly mixes with the surrounding soil body and solidifies to form a short cylinder 61 with a certain strength, and the center of the horizontal section of the short cylinder 61 coincides with the center of the drill rod 93;

step S6-6, referring to FIGS. 12 and 13, steps 6-4 and 6-5 are repeated until grouting to the bottom of the reinforcement 3; as shown in FIG. 14, all the continuous short cylinder 61 structures formed by grouting in repeated advancing and retreating form a complete reinforced composite pile foundation 6, and the top surface of the reinforced composite pile foundation 6 is combined with the reinforcement 3 to together form a pile plate structure to support the raft foundation 1.

As shown in FIGS. 7 and 8, in the engineering project, the bottom of the raft foundation 1 is further provided with a pipe pile 94. In order to enable the reinforced composite pile foundation 6 to partially or fully wrap the pipe pile 94, thereby increasing the side grinding resistance of the pipe pile 94 and enabling the supporting force of the pipe pile 94 to be enhanced, the effective diameter of the reinforced composite pile foundation 6 needs to be greater than the net interval between two adjacent pipe piles 94, and greater than 3 m. In the engineering project, the diameter is 3.5 m, and two pipe piles 94 are fully wrapped by the reinforced composite pile foundation 6. In order to meet the diameter requirements of reinforced composite pile foundation 6, the stable pressure value of grouting after each time stopping drilling or retreating is designed according to different grouting depths as follows: the pressure value between 0-20 m depth is 0.5 MPa-2.5 MPa; the pressure value between 20 m-30 m is 2.5 MPa-3.5 MPa, the pressure value between 30 m-40 m is 3.5 MPa-4.5 MPa, and the pressure value between 40 m-50 m is 4.5 MPa-5.5 MPa. Under this pressure state, the reinforced composite pile foundation 6 with a diameter of more than 3 meters can be formed so that the interval between two reinforced composite pile foundations 6 is increased to 8-12 meters, and the grouting material is saved and the construction efficiency is improved on the premise of meeting the requirement of bearing the load from the top building.

Preferably, before the integrally grouting strengthening operation, grouting parameter tests of the reinforced composite pile foundation 6 are conducted within the range of the house, and test pile construction is performed according to the pressure and other parameters disclosed above; after the test pile is completed, the geological drilling rig is adopted to drill a hole and take out the core at the center radius of 3 m of the reinforced composite pile foundation 6, and then it is observed whether the core sample is continuous reinforcement with good strength instead of ordinary soil body. The above parameters are mainly used to strengthen the foundation below the raft foundation 1 of the high-rise building. When the test is performed according to the above parameters outside the range of the raft foundation 1 of the site of the engineering project, the diameter of the grout diffusion increases to 6 m, which is completely different from the effective radius of the reinforced composite pile foundation 6 formed by grouting inside the range of the raft foundation 1.

The principle analysis of the construction process for reinforced composite pile foundation 6 is as follows: as shown in FIGS. 12 and 13, when the drill rod 93 drills to a design depth and performs grouting, and filling grouting is performed at different depths after each retreating, the main purpose is to fill a relatively less compact area around the drill rod 93; since the injected grout has the characteristic of rapid solidification, the injected grout does not spread too far along the relatively less compact area. After this grouting, the grouting body formed by the injected grout and the soil body forms an irregular shape around the drill rod 93, and the center of the horizontal section of the grouting body is far away from the center of the drill rod 93. Since the grout is not completely mixed with the soil body in this grouting, a part of the grout forms a tree-root-like structure as disclosed in the patent application document for the invention with the publication number CN107435346A. The stopping time of filling grouting is mainly controlled by the grouting pressure and secondarily controlled by the injection rate.

When the pressure grouting is performed by drilling and inserting downward into the range of the filled grouting body again, since the relatively less compact area around the drill rod 93 has been filled during filling grouting, the grouting will uniformly apply pressure to the soil body around the drill rod 93 so that the grout will uniformly permeate into the void between the surrounding soil body and the volcanic ash, thereby solidifying and forming a short cylinder 61 with a certain strength, and the center of the horizontal section of the short cylinder 61 coincides with the center of the drill rod 93. Pressure grouting is mainly controlled by the injection rate and secondarily controlled by the pressure. When the grouting pressure reaches a design value, but the injection rate is still lower than 50% of the design injection rate, the grouting pressure should be increased appropriately, and the grouting should be continued; when the injection rate reaches more than 70% of the design injection rate, the grouting can be stopped and retreating can be performed. As shown in FIG. 14, since the horizontal sectional centers of all the short cylinder 61 structures formed by pressure grouting are substantially overlapped with the center of the drill rod 93, all the short cylinder 61 structures form a complete reinforced composite pile foundation 6 in the vertical direction, and the top surface of the reinforced composite pile foundation 6 will be supported by the reinforcement 3.

Preferably, a secondary pressure grouting is performed in reinforcement 3 and between the top surface of the reinforced composite pile foundation 6 and the bottom surface of the raft foundation 1 so that the top end of the reinforced composite pile foundation 6 extends to the bottom surface of the raft foundation 1 to form a reinforced structure with better stress bearing.

S7, hole sealing: after the grouting is completed, all the drilling holes and removed protective layers on the raft foundation 1 are sealed and leveled with cement mortar with the same mark as or one mark higher the mark of the raft foundation 1.

Embodiment 2

When the foundation of the building is a special stratum such as collapsible loess and miscellaneous fill, the hole drilling and grouting operation adopts the integrally advancing grouting process, but not the integrally retreating grouting. Because the drill rod needs to be drilled to the design depth at one time in the integrally retreating grouting construction, in the procedure of drilling into the design depth, the water ejected from the drill bit part will soften the surrounding soil body, resulting in the secondary settlement of the building. When the collapsible loess is drilled, although the drilling speed is high and there is not much water flowing out at the drill bit, the collapsible loess will sink once in the water. So it is impossible to use the scheme of one-time drilling into the design depth. When drilling into the miscellaneous fill soil layer, it often encounters backfilled schist and so on. When drilling into the schist, the drilling speed slows down and more water flows out at the drill bit, which will soften the surrounding soil body and cause the secondary settlement of the building. With advancing drilling grouting is adopted, the soil body can be solidified in time by the injected grout to prevent the secondary settlement of the building.

The embodiment describes in detail how to form reinforcement 3 and a reinforced composite pile foundation 6 in a special stratum such as collapsible loess, miscellaneous fill, and the like.

Step S2, forming reinforcement 3: the difference from embodiment 1 is that the retreating grouting process is changed to the advancing grouting process. Specifically, when grouting, a drilling and grouting machine is adopted for hole drilling and grouting. A drill rod 93 drills from a reinforcement grouting hole 31 into a certain depth below the bottom of a raft foundation 1, for example, for 1.5 m, and then grouting is started, and after the grouting pressure reaches 0.8 MPa, drilling is continued for 1.5 m and grouting is started; the above operation is repeated repeatedly until drilling into the design depth (at 16 m). Finally, the drill rod 93 is pulled out and the drill hole is simultaneously filled with grout. Other reinforcement grouting holes 31 are then grouted by adopting the hole-jumping method. After all the reinforcement grouting holes 31 are grouted, a continuous and complete reinforcement 3 is formed at the bottom of the raft foundation 1.

Step S6, forming a reinforced pile foundation 6:

In step S6-1', a plurality of pile foundation holes 7 is drilled on the raft foundation 1.

Step S6-2', as shown in FIG. 3, the drill rod 93 of the drilling and grouting machine is inserted from the pile foundation hole 7 and then drilled into the soil layer below the bottom of the reinforcement 3; drilling is performed to a length L below the bottom of the reinforcement 3, L being 2.0 m, then drilling is stopped and filling and grouting are performed, and after the grouting reaches a certain grouting pressure and stabilizes, or after the injection rate of the grout satisfies the design requirement, the injected grout fills the void of the soil body around the drill rod 93 and the through gap channel 91 (see FIG. 15) or fills the relatively less compact area of the soil body around the drill rod 93 (see FIG. 18), and solidifies within 10 s-60 s. The grout solidifies to form a tree-root-like grouting body 92 or an irregular grouting body 8.

Figure 15:
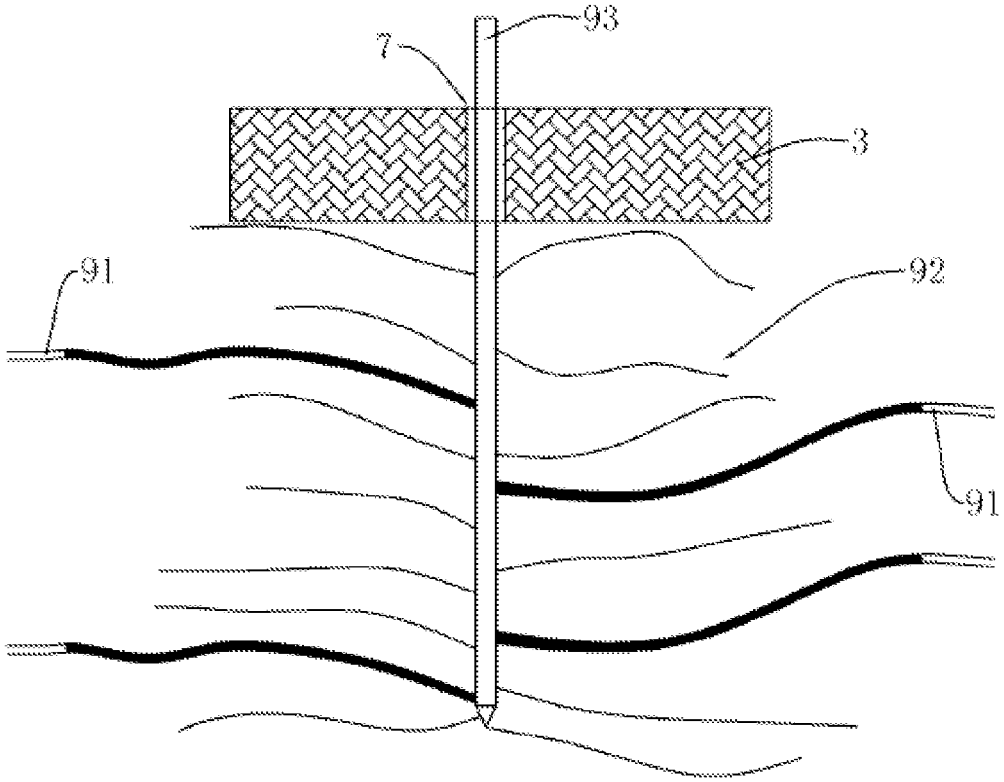
FIG. 15 is a schematic view of a tree-root-like grouting body formed by filling grouting after drilling downwards a length of L in a miscellaneous fill stratum.
Figure 16:
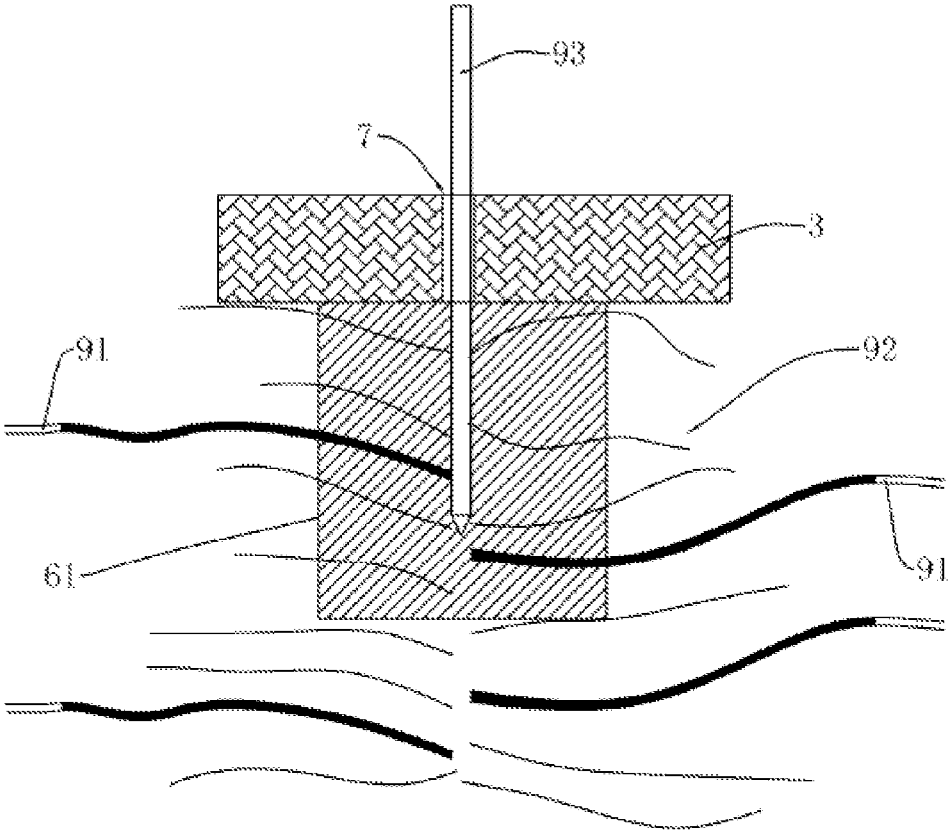
FIG. 16 is a schematic view of a short cylinder formed by pressure grouting after the drill rod retreats ½L in the miscellaneous fill stratum.
Figure 17:
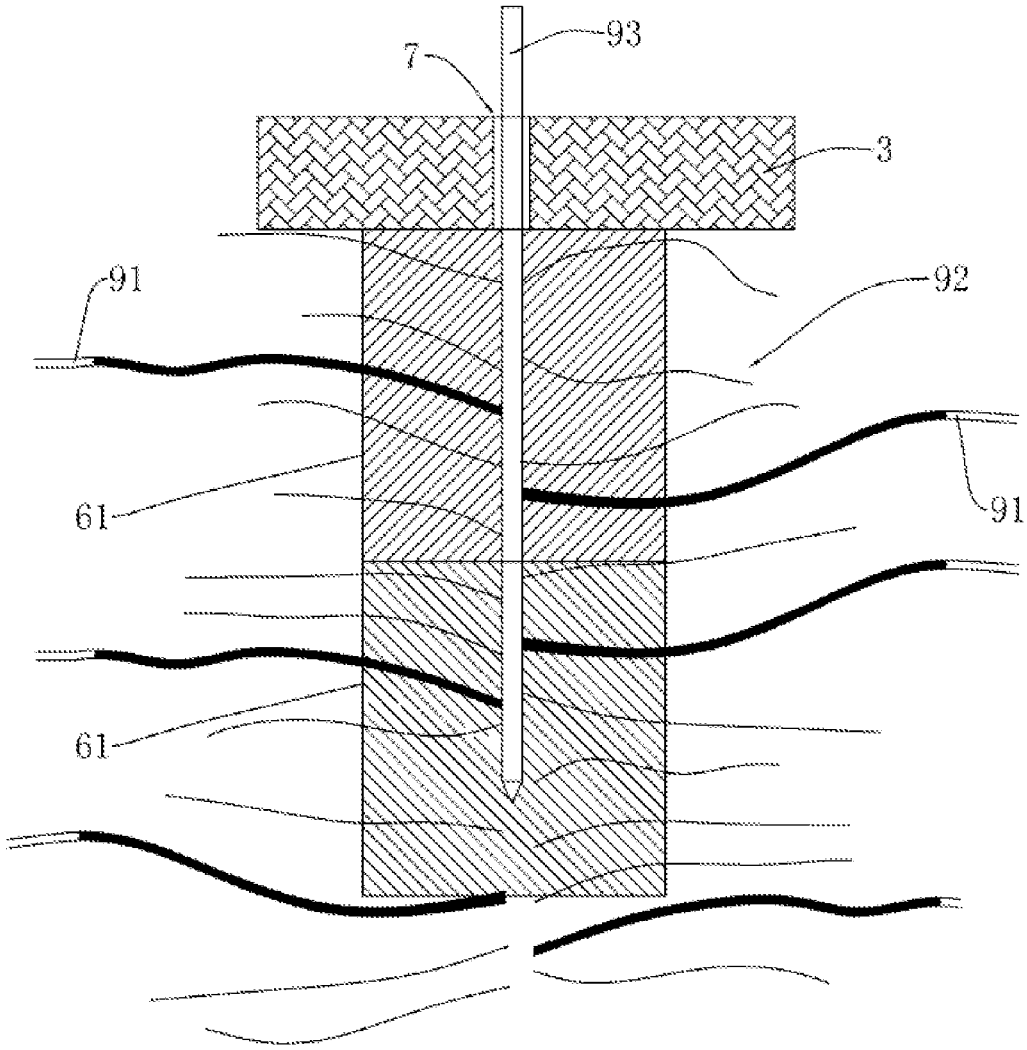
FIG. 17 is a schematic view of a short cylinder formed by a second pressure grouting after a cyclic operation in the miscellaneous fill stratum.
Figure 18:
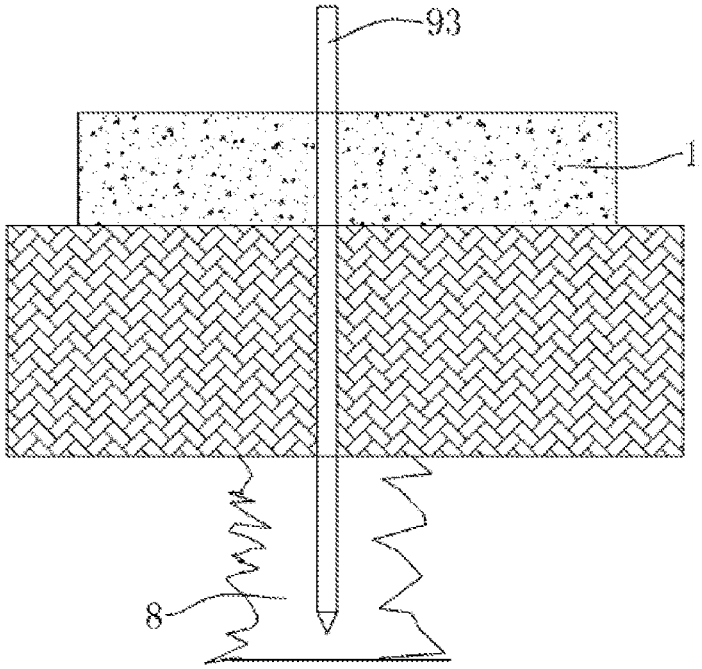
FIG. 18 is a schematic view of an irregular grouting body formed by filling grouting after drilling downwards a length of L in a collapsible loess stratum.
Figure 19:
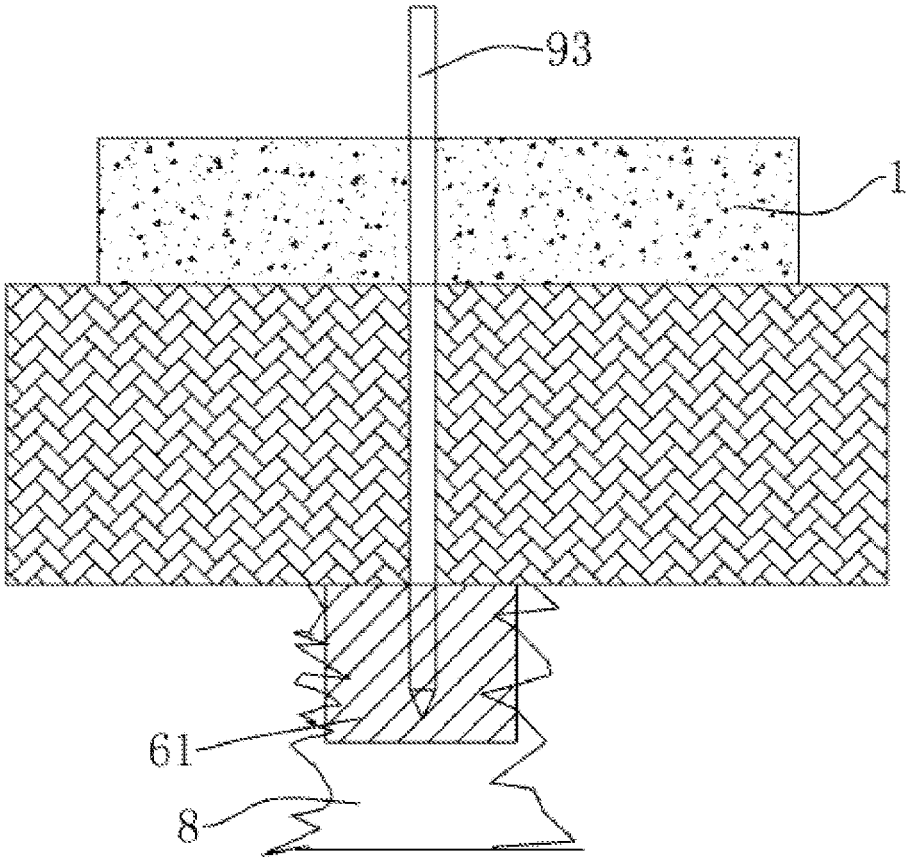
FIG. 19 is a schematic view of a short cylinder formed by pressure grouting after the drill rod retreats ½ in the collapsible loess stratum.

Hereinafter, FIGS. 15 to 17 are views illustrating that a tree-root-like grouting body 92 is formed by firstly filling the void of a surrounding soil body and a through gap channel 91 at the time of filling grouting in a miscellaneous fill stratum; FIGS. 18 to 19 are views illustrating that an irregular grouting body is formed by firstly filling a relatively less compact area of the soil body around the drill rod 93 at the time of filling grouting in the collapsible loess stratum.

Step S6-3', as shown in FIGS. 16 and 19, the drill rod 93 retreats upwards for a length of half of the drilling length L, then retreating is stopped and pressure grouting is performed; in S6-2', in the range of the tree-root-like grouting body 92 or the irregular grouting body 8 formed by grouting, the grout uniformly diffuses to the periphery, and after the grouting reaches a certain pressure and stabilizes, or after the injection rate of the grout satisfies the design requirement, the grout uniformly mixes with the surrounding soil body and solidifies to form a short cylinder 61 with a certain strength, the center of the horizontal section of the short cylinder 61 coinciding with the center of the drill rod 93.

Step S6-4', as shown in FIGS. 17 and 14, steps 6-2' and 6-3' are repeated until grouting to the design depth.

In step S6-5', the drill rod 93 is pulled out upward, and meanwhile, the drilling hole is filled and compacted by injecting the grout.

In step S6-6', as shown in FIGS. 14 and 17, all the continuous short cylinder 61 structures formed by grouting in repeated advancing and retreating form a complete reinforced composite pile foundation 6, and the reinforced composite pile foundation 6 and the reinforcement 3 form a pile plate structure to support the raft foundation 1.

It should be noted that the grouting is performed only once at each depth to form the reinforcement 3, but since the reinforcement 3 forms a whole piece reinforcement at the bottom of the raft foundation 1, the reinforcement 3 mainly bears the stress integrally; the interval between two adjacent piles of the reinforced composite pile foundation 6 is far, so the piles are independently stressed, and the surrounding soil body has a small constraint force on the pile body, so it is necessary to repeatedly advance and retreat to form a pile foundation structure with an effective diameter.

Preferably, a secondary pressure grouting is performed in the reinforcement 3 and between the top surface of the reinforced composite pile foundation 6 and the bottom surface of the raft foundation 1 so that the top end of the reinforced composite pile foundation 6 extends to the bottom surface of the raft foundation 1 to form a reinforced structure with better stress bearing.

Embodiment 3

Figure 20:
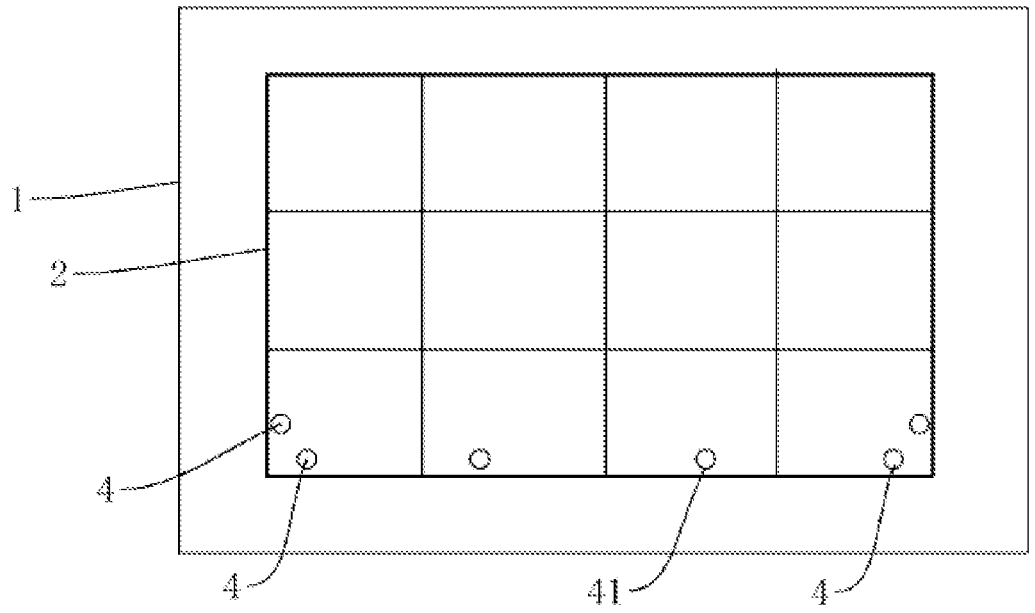
FIG. 20 is a schematic top view showing an arrangement position of a lifting hole in embodiment 3 of the present application.

In embodiment 1, the lifting hole 4 is provided on the outer side of the raft foundation 1, avoiding the hole drilling of the raft foundation 1, protecting the raft foundation 1 from damage, and drilling without the need to adopt special tools such as water drill, thereby improving the working efficiency. However, sometimes there is insufficient operating space at the periphery of the building, and in this case, as shown in FIG. 20, lifting hole 4 needs to be provided inside the building. On the side to be lifted of the building, the vertical lifting hole 4 is arranged tightly contacting with the load bearing wall 2, the vertical lifting hole 4 penetrates the raft foundation 1, and the bottom of the hole extends to a position close to the bottom of the reinforcement 3.

A rebar protective layer on the surface of the raft foundation 1 is broken at the lifting hole 4 to expose the raft rebar. A water drill is used to drill downward between the rebar gaps of the raft foundation 1 to form a reinforcement grouting hole 31.

There are two reasons for using the vertical drilling hole in the scheme. One is that raft foundation 1 is provided therein with a rebar mesh close to the upper surface and the lower surface. When inclined hole drilling is performed, the probability of drilling onto the rebar is very high. The construction schedule is seriously affected by drilling at a plurality of replacement positions, and the structure of raft foundation 1 is damaged. After the protective layer is broken, the rebar gap can be accurately found, and since the gap positions of the upper layer and lower layer of the rebar mesh sheets of the raft foundation 1 are opposite, drilling vertically can substantially pass through the rebar gap of the lower layer, thereby greatly improving the construction efficiency and minimizing the structural damage.

The other reason is that after the inclined hole drilling, although the bottom of the lifting hole 4 extends to be directly below the load bearing wall 2, which is advantageous for grouting lifting, since the lifting holes 4 are inclined in one direction towards the center of the building and in one direction towards the periphery of the building compared with the inclinedly arranged hole in embodiment 1, the material used for the lifting hole 4 inclined outwards exceeds more than 30% of the material used for the lifting hole 4 inclined inwards under the same conditions through practical operation on site. The scheme of arranging holes vertically and tightly contacting with the load bearing wall 2 in the embodiment saves more than 15% of the material compared with the scheme of lifting hole 4 inclined outwards.

Preferably, a number of reinforcement grouting holes 31 can be arranged in advance on the inner side of the load bearing wall 2 on the side to be lifted and provided tightly contacting with the load bearing wall 2. A part of the reinforcing lifting holes 4 can be selected as the lifting reinforcing holes during the lifting grouting operation.

Embodiment 4

Figure 21:
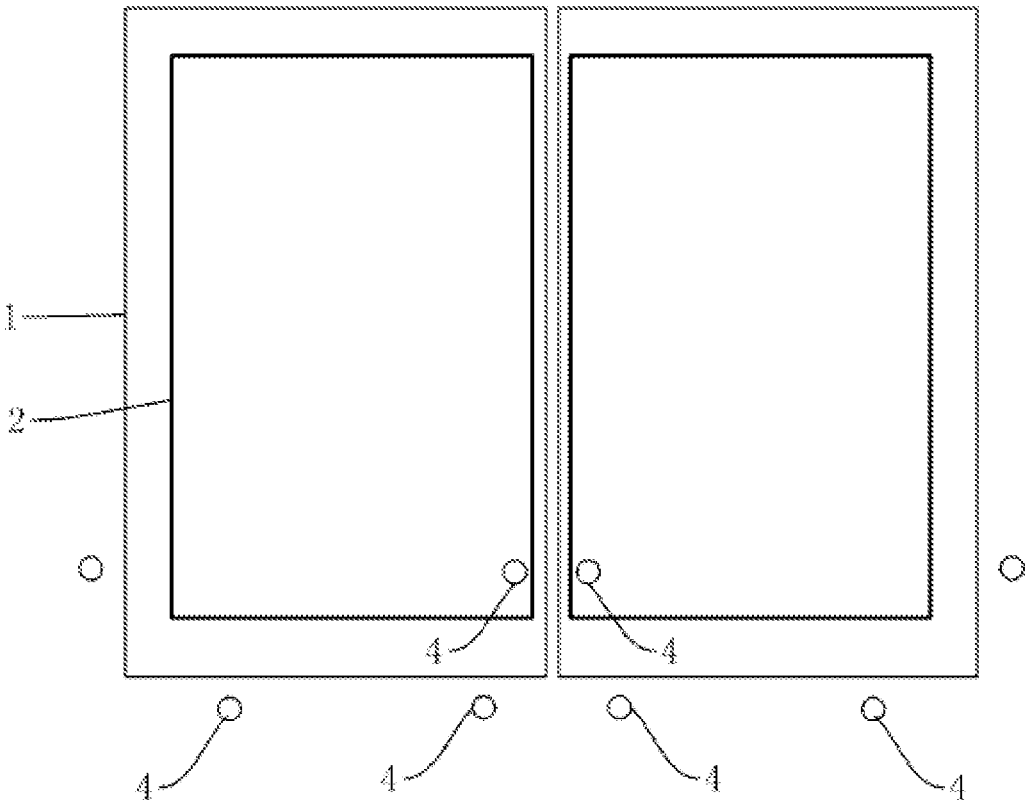
FIG. 21 is a schematic top view showing an arrangement position of a lifting hole when two buildings are immediately adjacent in embodiment 4 of the present application.

With reference to FIG. 21, in practical buildings, it is sometimes encountered that two unit buildings are close to each other, and only about 10 cm of settlement joint is left in front of adjacent units. At this time, it is obviously inappropriate to arrange a lifting hole 4 on the immediately adjacent side of the building. Furthermore, since one lifting hole 4 is insufficient to uniformly lift the building upwards, so two lifting holes 4 are arranged at this moment. One lifting hole 4 provided as above by being provided inclinedly on the outer side of the building. The other lifting hole 4 is provided vertically at the inner side of the building close to the wall body of the building. The two lifting holes 4 are respectively provided on different sides of a corner of the building. When lifting is performed, grouting lifting is performed at the same time.

In the reinforcement grouting and lifting grouting mentioned in the above embodiments, as well as the filling grouting and pressure grouting in the procedure of forming the reinforced composite pile foundation, the injected grout used is a two-component composite grout. For the convenience of expression, they are named grout A and grout B. The two grouts respectively reach the grout outlet of the grouting pipe (namely, the drill rod 93) from different channels of the drill rod, are pressed into the surrounding soil body at the grout outlet, and converge in the soil body to perform a chemical reaction. The initial set is completed in a short time.

The injected grout can be any one of the prior art as long as it can meet the initial setting time requirement and has good permeability.

The following injected grout formula can be adopted: grout A consists of the following raw materials in parts by weight: 70-90 parts of metal oxide and/or metal hydroxide, 0.5-1.2 parts of composite retarder, 0.5-0.7 parts of water reducer, 0.7-1.5 parts of acid-base buffer agent, 3-5 parts of composite stabilizer, and 0.5-1.5 parts of composite surfactant. The oxidation metal can be a combination of any two of magnesium oxide, aluminum oxide, magnesium phosphate, and the like; the composite retarder is at least two of urea, borax, and sodium tripolyphosphate; the water reducer can be a polycarboxylic acid water reducer or a naphthalene water reducer; the acid-base buffer agent is magnesium carbonate or potassium hydroxide; the composite stabilizer is at least two of hydroxymethyl cellulose, n-alkyl cetyl alcohol, starch ether, and cellulose ether; the composite surfactant is at least two of alkyl polyoxyethylene ether, benzyl phenol polyoxyethylene ether, and alkane sulfonate. When two or more different materials mentioned above are used in each of the above separate components, they can be formulated in an equal order of magnitude, the two being arranged primarily to prevent one from failing so that the overall composite grout effect is more stable.

Grout B consists of the following raw materials in parts by weight: 30-40 parts of phosphate and 0.2-1 parts of the defoaming agent. The phosphate can be diammonium hydrogen phosphate or potassium dihydrogen phosphate; the defoaming agent can be the organosilicon defoaming agent or polyether defoaming agent.

Grout A and grout B are mixed with water in a weight ratio of 100:40-50 respectively to be stirred to form a grout, and are pressed into the grout injecting pipe via different pipelines, converge at the grout outlet and react, and solidify in the soil body.

The embodiments in the detailed description are preferred embodiments of the present application, and are not intended to limit the scope of the present application. So: all equivalent changes made in accordance with the structure, shape, and principle of the present application should be covered by the scope of the present application.

In the drawings, 1, raft foundation; 2, load bearing wall; 3, reinforcement; 31, reinforcement grouting hole; 4, lifting hole; 41, densification lifting hole; 5, reinforcing hole; 6, reinforced composite pile foundation; 61, short cylinder; 7, pile foundation hole; 8, irregular grouting body; 91, gap channel; 92, tree-root-like grouting body; 93, drill rod; 94, pipe pile; and 11-14, four corner points.

What is claimed is:

1. A method for strengthening and lifting a high-rise building having a raft foundation, comprising:

S1, arranging measuring points: a bottom of the building comprising a raft foundation, arranging a plurality of measuring points at intervals around an outer wall of the building, and determining one side where two points with larger settlement volumes in four corners of the building are located as a side to be lifted according to elevations of the measuring points;

S2, forming a reinforcement: arranging a plurality of reinforcement grouting holes perpendicular to the raft foundation at intervals within a range of the raft foundation, and performing pressure grouting in the reinforcement grouting holes to form a continuous and complete reinforcement greater than a thickness of the raft under the raft foundation;

S3, arranging lifting holes: arranging vertical lifting holes on the raft foundation tightly close to a load bearing wall at a position close to two ends of the load bearing wall on the side to be lifted of the building, wherein the vertical lifting holes penetrates through the raft foundation, and bottoms of the holes extends to a position close to a bottom of the reinforcement; or arranging downwardly inclined lifting holes on an outer side of the raft foundation, wherein the bottom of the holes extends to a position close to the bottom of the reinforcement and is located directly below the load bearing wall;

S4, lifting: performing pressure grouting in the lifting holes simultaneously to lift the side to be lifted of the building, and during the lifting, controlling a lifting speed of two corners of the building of the side to be lifted such that elevations of the two corners is finally lifted simultaneously to a same height as the elevation of corresponding corners of a side not to be lifted of the building; and S5, forming a reinforced pile foundation: drilling a plurality of pile foundation holes on the raft foundation, wherein a drill rod extends from the pile foundation holes into a soil layer below the bottom of the reinforcement, and in a drilling and/or retreating procedure, performing pressure grouting segment by segment and layer by layer to form a continuous reinforced pile foundation; and wherein the reinforced pile foundation and the reinforcement are combined to form a pile plate reinforced structure for supporting the raft foundation and the building thereon together;

wherein the drill rod repeatedly drills and retreats in the pile foundation hole for grouting, pressure grouting is performed twice in each segment of the soil layer; a first pressure grouting is filling grouting, and an irregular grouting body is formed around the drill rod after the filling grouting; a second pressure grouting is performed inside the irregular grouting body formed by the filling grouting, in the second pressure grouting, grout uniformly diffuses to a periphery and uniformly mixes with soil body to form a short cylinder with a center of a horizontal section coinciding with a center of the drill rod; all upper and lower continuous short cylinders form a reinforced composite pile foundation, and the reinforced composite pile foundation and the reinforcement are combined to form a pile plate reinforced structure for supporting the raft foundation and the building thereon together.

2. The method for strengthening and lifting a high-rise building having a raft foundation according to claim 1, wherein, in S5, the drill rod of a drilling and grouting machine drilling to a design depth at one time to perform filling grouting, wherein after the grouting reaches a certain grouting pressure and stabilizes, or after an injection rate of the grout satisfies a design requirement, the injected grout fills a relatively less compact area of the soil body around the drill rod, and solidifies within 10 s-60 s, to form the irregular grouting body; the drill rod retreating upward by a retreating length of L and stopping the retreating, and performing filling grouting continually, wherein after the grouting reaches a certain grouting pressure and stabilizes, or after the injection rate of the grout satisfies the design requirement, stopping the grouting to form the irregular grouting body; the drill rod drilling downward again by an advancing length of a half of the retreating length L, then stopping the drilling and performing pressure grouting; in the range of the irregular grouting body, the grout uniformly diffuses to the periphery, after the grouting reaches a certain pressure and stabilizes, or after the injection rate of the grout satisfies the design requirement, the grout uniformly mixes with the surrounding soil body and solidifies to form the short cylinder with a certain strength, and the center of the horizontal section of the short cylinder coincides with the center of a grouting pipe; repeating the drilling, the retreating and the grouting until the bottom of the reinforcement is reached.

3. The method for strengthening and lifting a high-rise building having a raft foundation according to claim 1, wherein, in S5, the drill rod drilling to a length L below the bottom of the reinforcement and performing filling grouting, and after the grouting reaches a certain grouting pressure and stabilizes, or after the injection rate of the grout satisfies the design requirement, stopping the grouting; the injected grout fills soil voids and through gap channels surrounding the drill rod or fills a relatively less compact area of the soil body surrounding the drill rod, and solidifies within 10 s-60 s; the grout solidifies to form a tree-root-like grouting body or the irregular grouting body; the drill rod retreating upwards by a retreating length of a half of a drilling length L, then stopping the retreating and performing pressure grouting; in a range of the tree-root-like grouting body or the irregular grouting body, the grout uniformly diffuses to the periphery, after the grouting reaches a certain pressure and stabilizes, or after the injection rate of the grout satisfies the design requirement, the grout uniformly mixes with the surrounding soil body and solidifies to form the short cylinder with a certain strength, and the center of the horizontal section of the short cylinder coincides with the center of a grouting pipe; repeating the drilling, the retreating and the grouting until the design depth is reached; pulling out the drill rod upwards and during the pulling out and injecting the grout meanwhile to fill the drilling holes tightly.

4. The method for strengthening and lifting a high-rise building having a raft foundation according to claim 1, wherein, in S5, during the filling grouting and the pressure grouting, a pressure value between 0-20 m is 0.5 MPa-2.5 MPa, a pressure value between 20 m-30 m is 2.5 MPa-3.5 MPa, a pressure value between 30 m-40 m is 3.5 MPa-4.5 MPa, and a pressure value between 40 m-50 m is 4.5 MPa-5.5 MPa.

5. The method for strengthening and lifting a high-rise building having a raft foundation according to claim 1, wherein, a secondary grouting is performed in the reinforcement, and between a top surface of the reinforced pile foundation and a bottom surface of the raft foundation so that a top end of the reinforced pile foundation extends to the bottom surface of the raft foundation.

6. The method for strengthening and lifting a high-rise building having a raft foundation according to claim 1, further comprising: S4-1, filling and reinforcing: arranging a reinforcing hole in a middle position of the raft foundation, wherein a bottom of the reinforcing hole extends to a joint surface of the raft foundation and the reinforcement; performing grouting at a bottom end of the reinforcing hole to fill all voids between the bottom surface of the raft foundation and the top surface of the reinforcement tightly.

7. The method for strengthening and lifting a high-rise building having a raft foundation according to claim 1, wherein, a plurality of densification lifting holes are arranged at intervals between original lifting holes along a length direction of a wall body on the side to be lifted; pressure grouting is performed in all the lifting holes at the same time to lift the side to be lifted of the building, and when lifting, a lifting speed of the load bearing wall of the building at each lifting point is controlled so that each point of the side to be lifted of the building is uniformly lifted, until each point of the side to be lifted is lifted simultaneously to a same height as an elevation of a corresponding position of the side not to be lifted of the building.

8. The method for strengthening and lifting a high-rise building having a raft foundation according to claim 1, wherein, in S3, the lifting holes are arranged on an outer side of the raft foundation, two lifting holes are correspondingly arranged at each building corner of the side to be lifted, and the two lifting holes are respectively located on outer sides of two outer contour lines perpendicular to each other of the raft foundation; bottoms of the two lifting holes respectively extend directly below two load bearing walls that are perpendicular to each other.

9. The method for strengthening and lifting a high-rise building having a raft foundation according to claim 1, wherein, in S4, during the lifting, an intermittent grouting lifting is adopted, in which the grouting is firstly performed for lifting by a certain height, the grouting is suspended for a period of time, and then the grouting is performed for lifting by a certain height.

* * * * *